US011377924B2

(12) United States Patent
Mitchell

(10) Patent No.: US 11,377,924 B2
(45) Date of Patent: Jul. 5, 2022

(54) METHOD AND SYSTEM FOR BOOSTING SEALING ELEMENTS OF DOWNHOLE BARRIERS

(71) Applicant: WEATHERFORD TECHNOLOGY HOLDINGS, LLC, Houston, TX (US)

(72) Inventor: Michael W. Mitchell, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 17/607,854

(22) PCT Filed: Jun. 1, 2020

(86) PCT No.: PCT/US2020/035504
§ 371 (c)(1),
(2) Date: Oct. 29, 2021

(87) PCT Pub. No.: WO2020/251789
PCT Pub. Date: Dec. 17, 2020

(65) Prior Publication Data

US 2022/0145721 A1 May 12, 2022

Related U.S. Application Data

(60) Provisional application No. 62/859,977, filed on Jun. 11, 2019.

(51) Int. Cl.
*E21B 33/129* (2006.01)
*E21B 33/128* (2006.01)

(52) U.S. Cl.
CPC ..... *E21B 33/1291* (2013.01); *E21B 33/128* (2013.01); *E21B 33/129* (2013.01)

(58) Field of Classification Search
CPC ... E21B 33/1291; E21B 33/128; E21B 33/129
See application file for complete search history.

(56) References Cited

U.S. PATENT DOCUMENTS 5,024,270 A * 6/1991 Bostick ..... E21B 23/065 166/134
9,512,693 B2 12/2016 Derby
(Continued)

OTHER PUBLICATIONS

International Search Report with Written Opinion dated Aug. 31, 2020 for PCT Patent Application No. PCT/US2020/035504, 13 pages.

(Continued)

*Primary Examiner* — Yong-Suk (Philip) Ro
(74) *Attorney, Agent, or Firm* — Smith IP Services, P.C.

(57) ABSTRACT

A downhole barrier can include a housing disposed between a slip and a seal element, a mandrel extending through the housing and the seal element, and a piston fixed to the mandrel and separating two chambers in the housing. One chamber is positioned between the slip and the other chamber, and is in communication with a passage in the mandrel. The other chamber is in communication with an exterior of the barrier. A system can include a downhole barrier set in a wellbore. The barrier can include a housing disposed between a slip and a seal element, a mandrel, and a piston fixed to the mandrel, the piston separating two chambers in the housing. An outer area of the mandrel in one chamber is equal to twice a difference between an inner area of the housing and an outer area of the mandrel in the other chamber.

20 Claims, 25 Drawing Sheets

(56) References Cited

U.S. PATENT DOCUMENTS

| | | | | |
|---|---|---|---|---|
| 2003/0098164 | A1 | 5/2003 | Hirth | |
| 2003/0132008 | A1 | 7/2003 | Hirth | |
| 2009/0107675 | A1* | 4/2009 | Eriksen | E21B 10/64 175/203 |
| 2011/0056676 | A1* | 3/2011 | Birner | E21B 33/1295 166/120 |
| 2020/0088001 | A1* | 3/2020 | Morland | E21B 23/04 |
| 2020/0277837 | A1* | 9/2020 | Hern | E21B 33/1293 |
| 2020/0308922 | A1* | 10/2020 | Greci | E21B 33/12 |

OTHER PUBLICATIONS

Canadian Examination Report dated Dec. 7, 2021 for CA Patent Application No. 3,138,587, 5 pages.

International Search Report and Written Opinion dated Aug. 31, 2021 for International Application No. PCT/US2020/035504, 13 pages.

* cited by examiner

METHOD AND SYSTEM FOR BOOSTING SEALING ELEMENTS OF DOWNHOLE BARRIERS

CROSS-REFERENCE TO RELATED APPLICATIONS

This application is a national stage under 35 USC 371 of International Application No. PCT/20/35504 filed on 1 Jun. 2020, which claims priority to U.S. Application No. 62/859,977 filed on 11 Jun. 2019. The entire disclosures of these prior applications are incorporated herein by this reference.

TECHNICAL FIELD

This disclosure relates generally to equipment utilized and operations performed in conjunction with a subterranean well and, in an example described below, more particularly provides a method and system for boosting sealing elements of downhole barriers.

BACKGROUND

A typical plug, packer or other downhole barrier for use in a subterranean well includes bi-directional slips which anchor the downhole barrier to well casing, tubing or other surface external to the barrier, prior to pack-off of a seal element to form a pressure seal. The pack-off force is applied to the seal element by compressing it between gage rings of the downhole barrier.

It is important for the seal element to remain sealed against the external surface, until the downhole barrier is intentionally unset, drilled through, or otherwise intentionally relieved of its sealing capability. If the seal element leaks prior to being intentionally relieved of its sealing capability, well operations may be severely compromised.

It will be appreciated, therefore, that improvements are continually needed in the art of constructing and utilizing downhole barriers.

DETAILED DESCRIPTION

Figure 1:
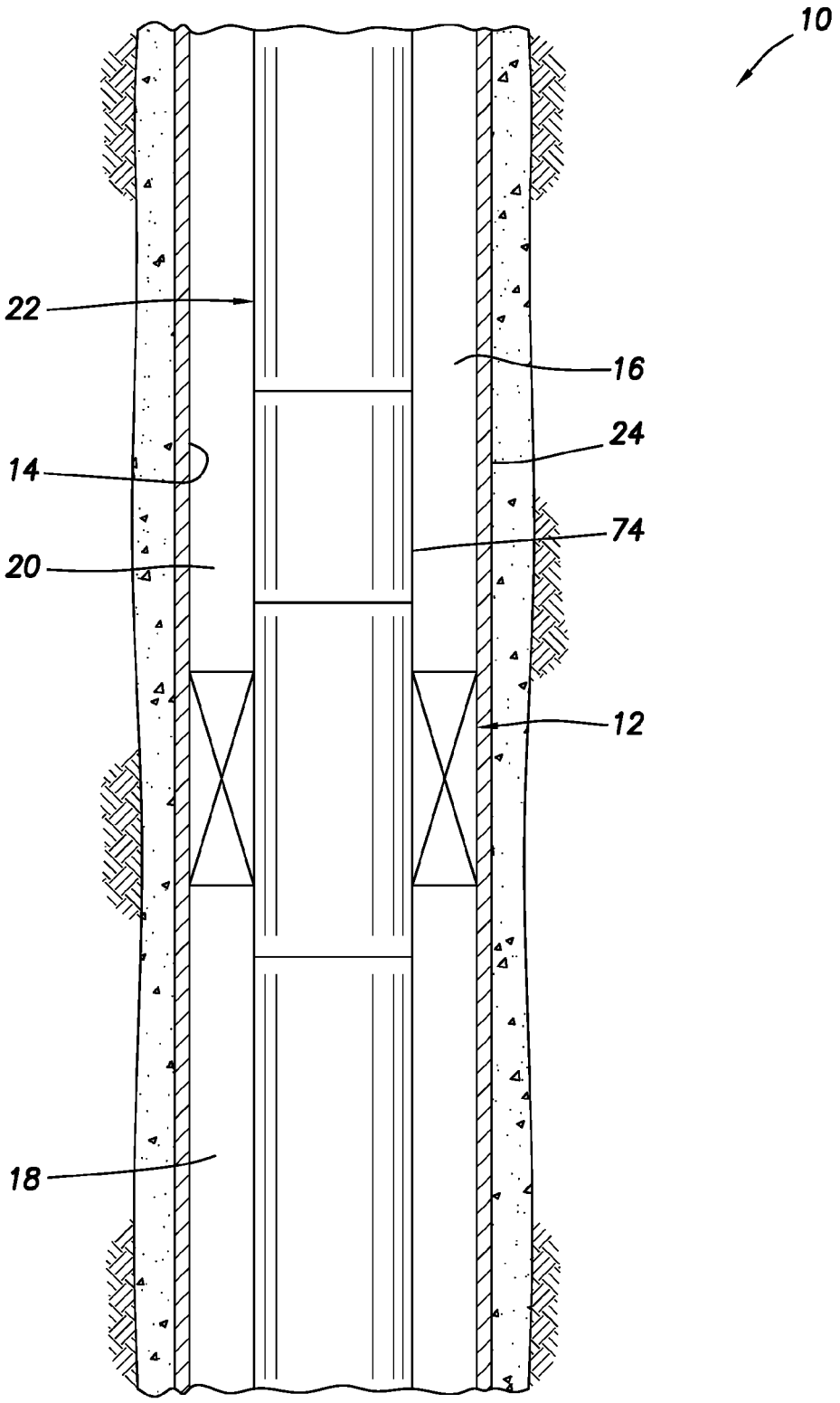
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a downhole barrier 12 is positioned in a wellbore 14 and is set therein. When set, the barrier 12 isolates an upper section 16 of the wellbore 14 from a lower section 18 of the wellbore. The barrier 12 blocks and prevents flow through an annulus 20 formed radially between a tubular string 22 and the wellbore 14.

The barrier 12 can be set in casing 24 that lines the wellbore 14, or the barrier could be set in another tubular string. In some examples, the barrier 12 may be set in an uncased or open hole section of the wellbore 14.

The downhole barrier 12 depicted in FIG. 1 is of the type known to those skilled in the art as a packer. In other examples, the downhole barrier 12 could be in the form of a bridge plug, a liner hanger or another type of downhole barrier. The scope of this disclosure is not limited to use of any particular type of downhole barrier.

Bridge plugs and packers are examples of downhole barriers that can be set at a predetermined depth anywhere within a wellbore, tubing or casing to facilitate a wide range of well support operations. Once installed, for example, they may be used to isolate the upper wellbore section 16 from production, or the lower wellbore section 18 from treatments conducted uphole.

For some conventional bridge plugs or packers, the seal element thereof is packed off (compressed so that it seals against an external surface) with an initial pack-off force. A distance between gage rings remains fixed after pack-off and while the seal element contacts the external surface. During well operations, as a differential pressure applied across the seal element changes (such as, due to variations in formation pressure and temperature in the wellbore), the element volume can change from its initial pack-off state.

With no additional pack-off force, these volume changes may reduce the seal element's ability to maintain its sealing engagement with the external surface. Therefore, when a subsequent differential pressure is applied, or when the direction of pressure is changed, these seal elements can lose their initial sealing capability and leak.

In some designs, a mandrel on which the seal element is carried is allowed to move axially (up or down) relative to the seal element. This allows a total area of the mandrel to be acted on by pressure in the wellbore above the barrier, resulting in a downwardly directed boost force applied to the seal element. This boost force can be excessive.

During well operations, as differential pressure is applied across the seal element at elevated temperature, the seal element may extrude past the gage rings and leak. Bridge plugs and packers with such boost systems tend to have different differential pressure ratings, depending on whether the differential pressure is applied from above or below. This situation does not maximize the sealing capability of the seal element.

Described below is a boost system (an apparatus to maintain seal element compression) in which the seal element does not disengage from the surrounding wellbore, casing or other tubular when exposed to fluctuating operational conditions, but instead maintains its sealing capability. This is a boost system that will adapt to a changing wellbore environment, and that supplies additional pack-off force to the seal element in response to an increase in pressure differential from above or below.

This system provides for control of boost areas subject to differential pressures from above and below. Therefore, any downhole barrier with this boost system can have a same pressure differential rating for differential pressures from above and below, and with enhanced sealing capability. However, it is not necessary in keeping with the principles of this disclosure for a downhole barrier to have an exact same pressure differential rating for differential pressures from above and below.

In one example, this boost system includes (see FIG. 4) a boost housing 32 slidingly arranged on a piston 34 formed on the mandrel 38, with a unidirectional body lock ring 36 to trap a boost force in a seal element 28. A difference in area between an inner seal bore (area B) of the housing 32 and a seal diameter (area C) on the mandrel 38 downhole of the piston 34 is a "downhole" boost area (B−C) that can be used to apply a compressive force to the seal element 28 due to a pressure differential from downhole to uphole across the barrier 12 (e.g., from the wellbore section 18 to the wellbore section 16 in the FIG. 1 system 10).

This method can be used to optimize boost areas (and resulting compressive forces) for enhanced sealing capability. The boost areas from uphole and downhole directions can be equal or different. As used herein, the downhole direction is toward a distal end of the wellbore 14 (farthest from surface along the wellbore) and the uphole direction is toward a proximal end of the wellbore (at the surface).

If the downhole boost area (B−C) is equal to the uphole boost area (A−B+C), then the outer area A of the mandrel 38 above the piston 34 is equal to twice the difference between the inner area B of the seal bore of the boost housing 32 and the outer area C of the mandrel below the piston (A=2×(B−C)). However, in some examples the downhole boost area may not be equal to the uphole boost area.

One example described herein comprises boost and counter-boost piston areas. A difference between the boost and counter-boost piston areas equals a resulting net boost area.

Figure 4:
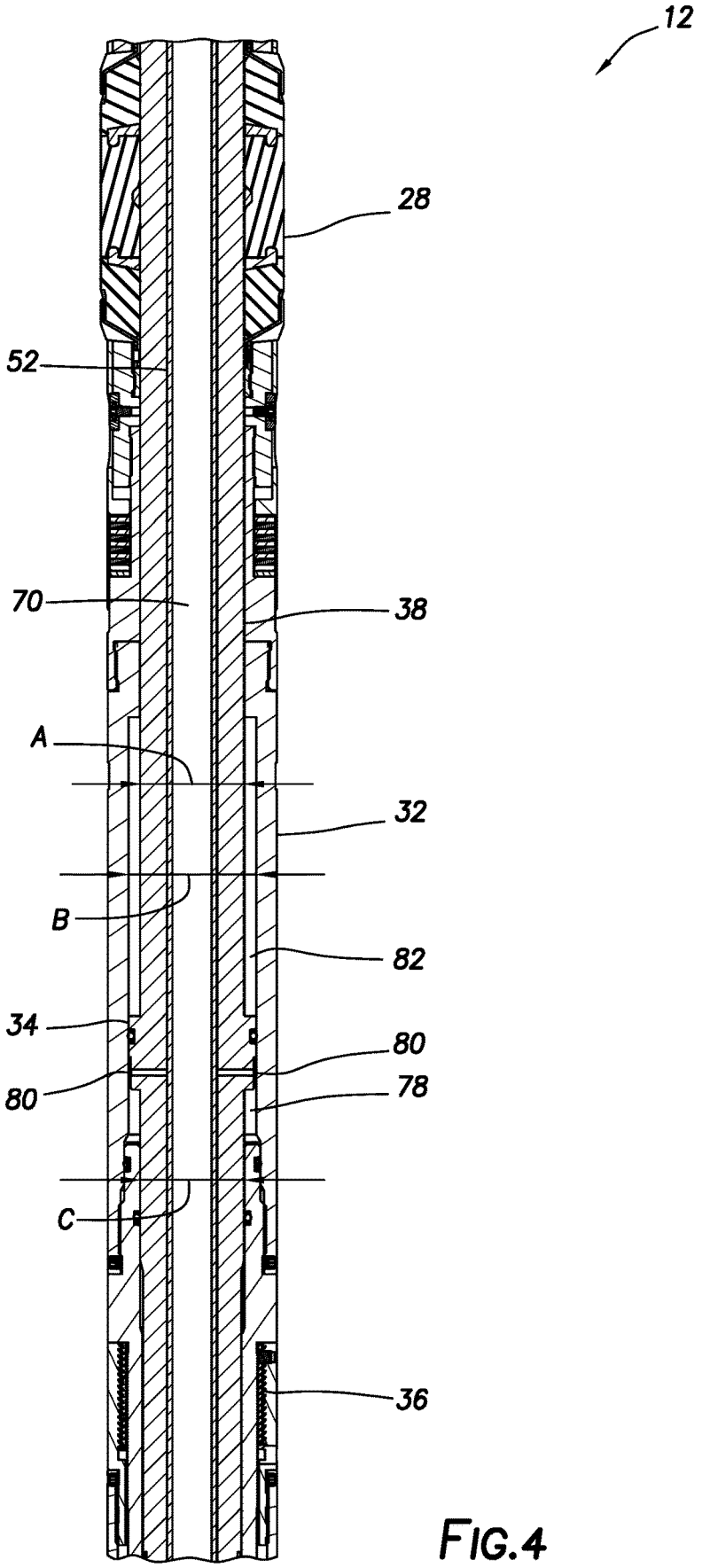
FIG. 4 is a representative cross-sectional view of a boost system of the downhole barrier.

Pressure applied to an inner mandrel 38 is used in the FIG. 4 example to apply a compressive force to the seal element 28 due to a pressure differential from uphole to downhole across the barrier 12 (e.g., from the wellbore section 16 to the wellbore section 18 in the FIG. 1 system 10). The difference in area between the mandrel 38 outer diameter (area A) on which the seal element 28 is seated and the boost area described above (B−C) equals the net boost area (A−B+C) that can be used to apply a compressive force to the seal element 28 due to a pressure differential from uphole to downhole across the barrier 12. A housing 40 that is connected to the mandrel 38 (see FIG. 7) has a unidirectional body lock ring 42 to trap the boost force (resulting from the pressure applied to the net boost area) in the seal element 28.

In this example, the piston 34 is used to cancel or balance some of the downwardly directed boost force due to pressure applied to the mandrel 38. This concept may be used with any type of downhole barrier with a "boosting" mandrel.

When a pressure differential is applied from above the seal element 28, the mandrel 38 will be biased to displace toward the seal element. The pressure differential multiplied by the net downward boost area will produce a compressive boost force on the seal element 28. This additional compressive force helps maintain the sealing capability of the seal element 28. The body lock ring 42 (see FIG. 7) is used to trap the compressive boost force in the seal element 28.

Alternatively, when a pressure differential is applied from downhole to uphole across the seal element 28, the housing 32 and piston 34 will be biased to displace toward the seal element to exert a compressive force on the seal element. The pressure differential multiplied by the net boost area will produce a compressive force on the seal element 28. This additional compressive force helps maintain the sealing capability of the seal element 28. The body lock ring 36 is used to trap the boost force in the seal element 28.

Figure 2A:
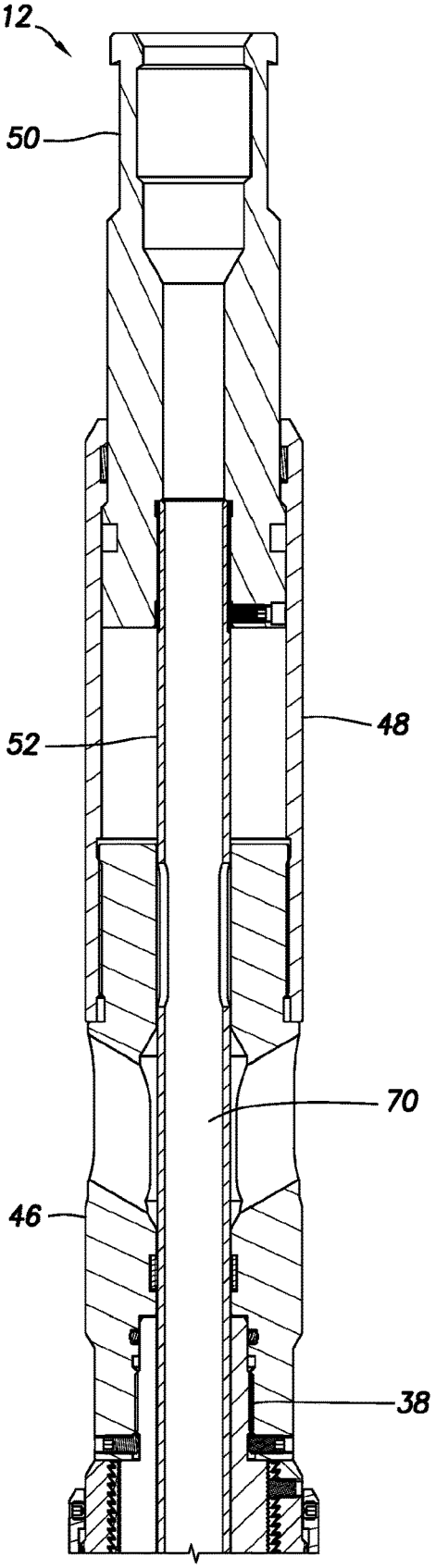
FIGS. 2A-G are representative cross-sectional views of successive axial sections of an example of a downhole barrier which can embody the principles of this disclosure, the downhole barrier being depicted in a run-in configuration.
Figure 2B:
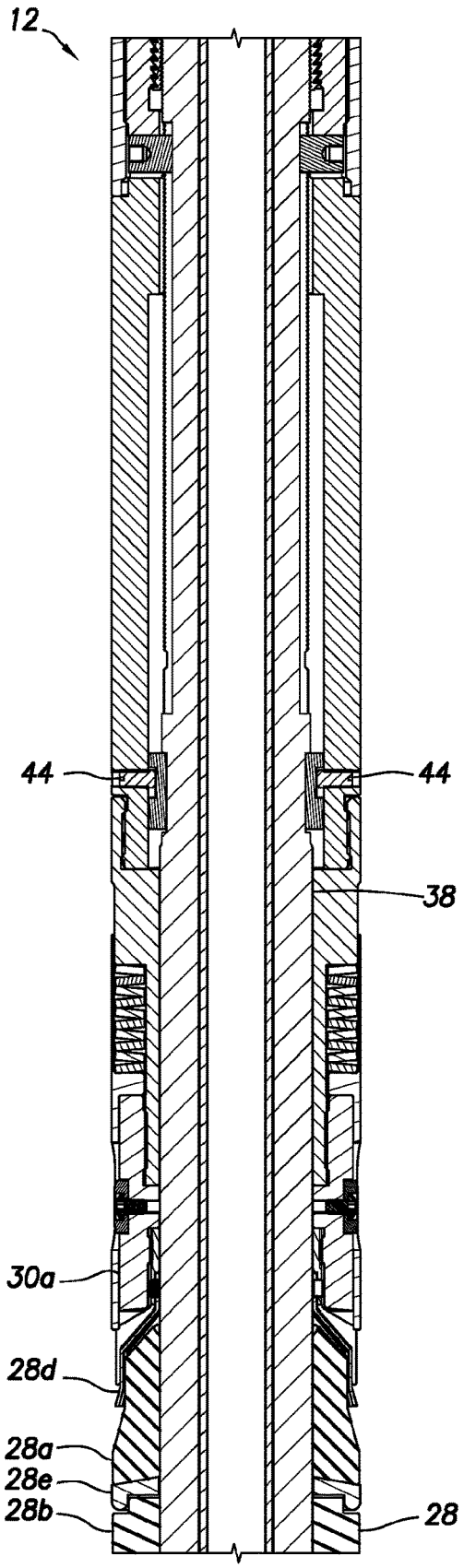
Figure 2C:
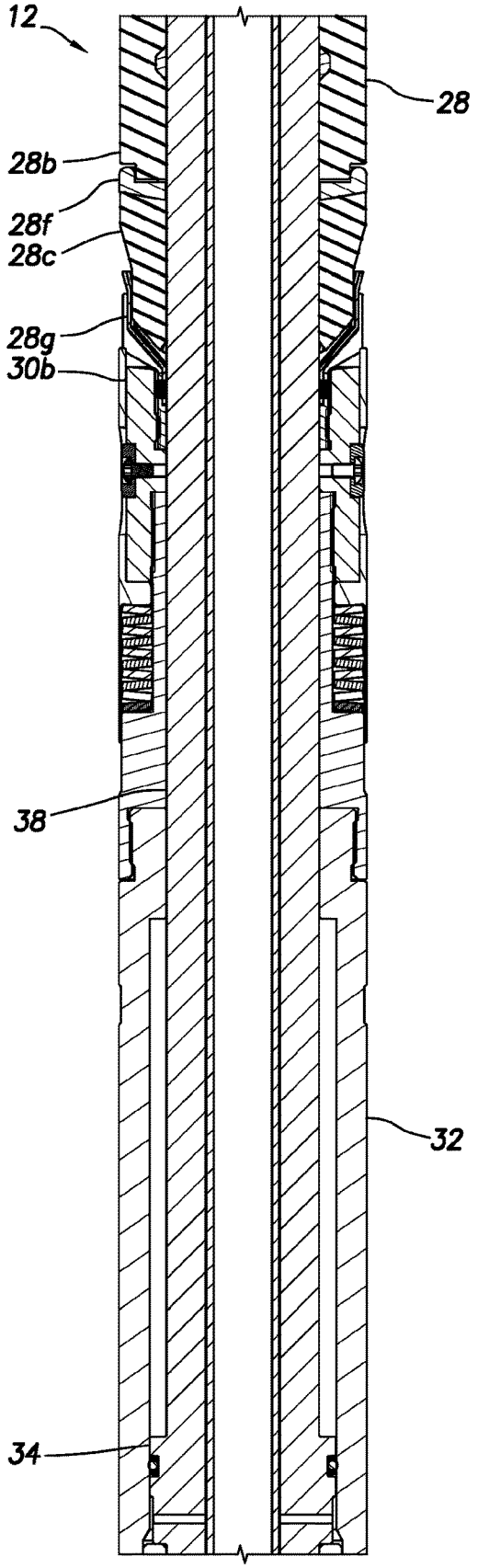
Figure 2D:
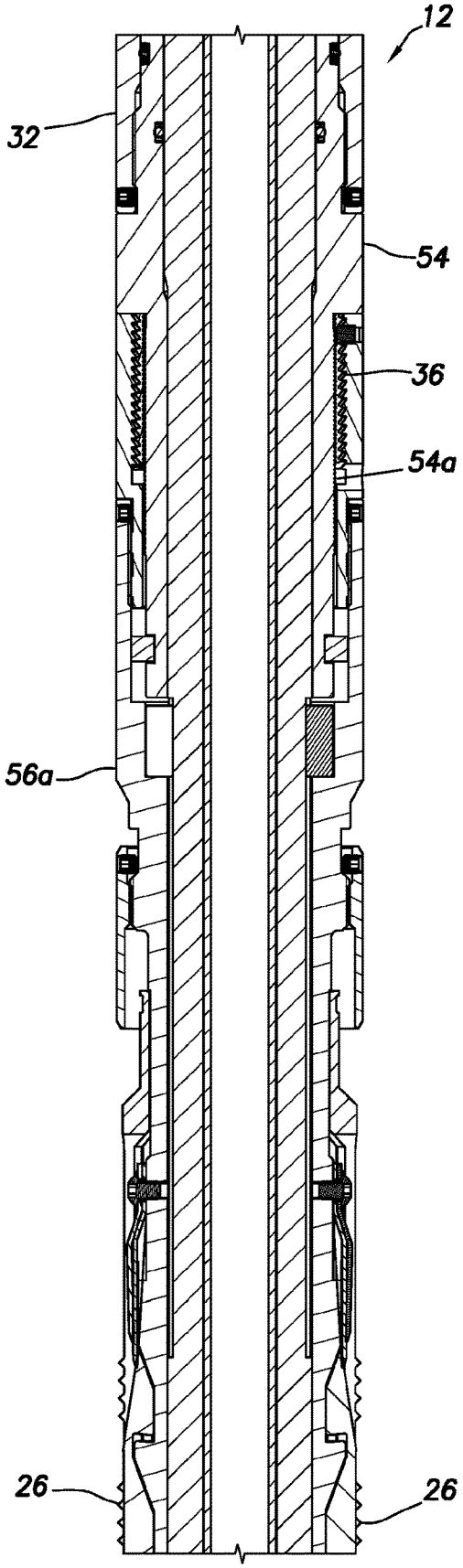
Figure 2E:
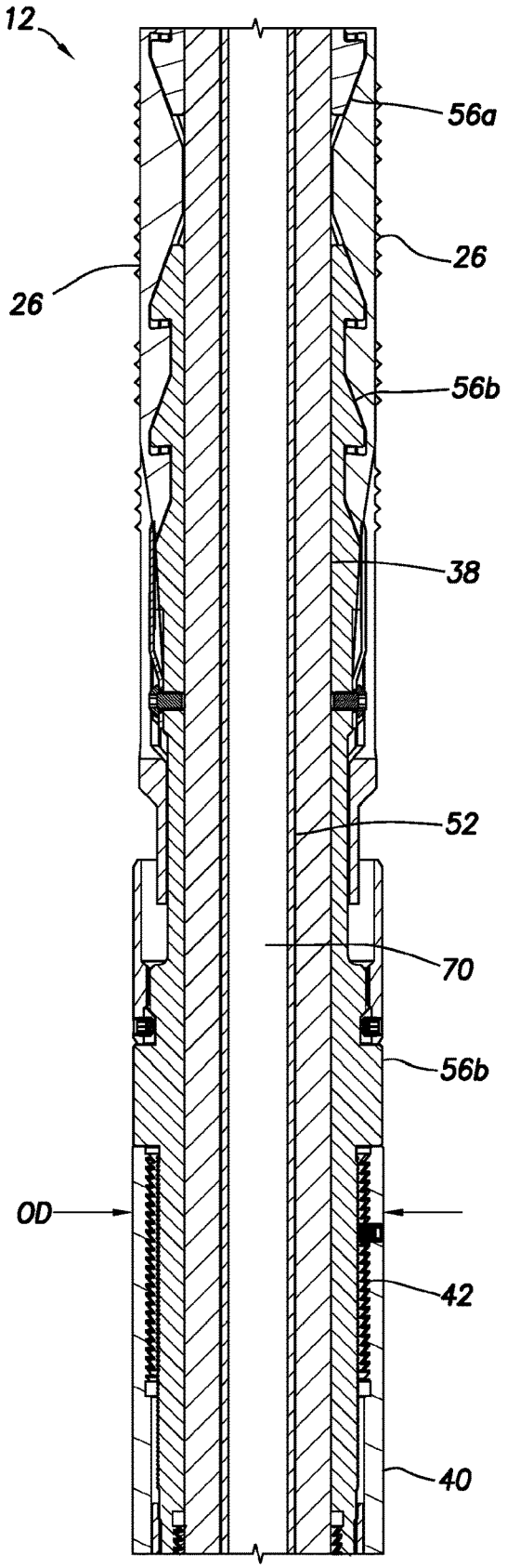
Figure 2F:
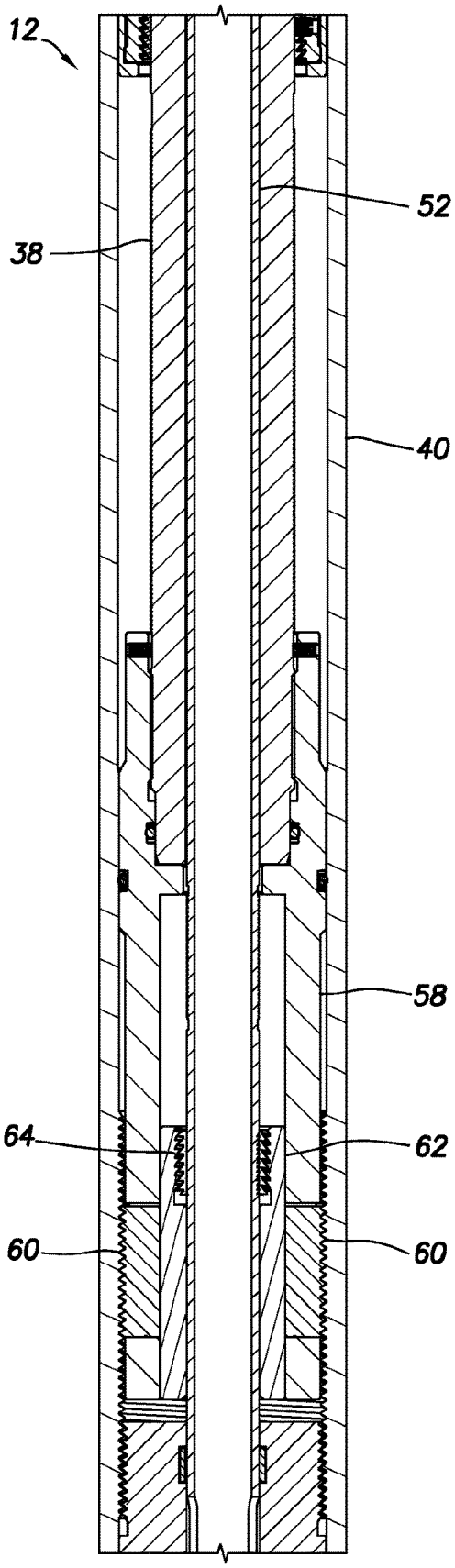
Figure 2G:
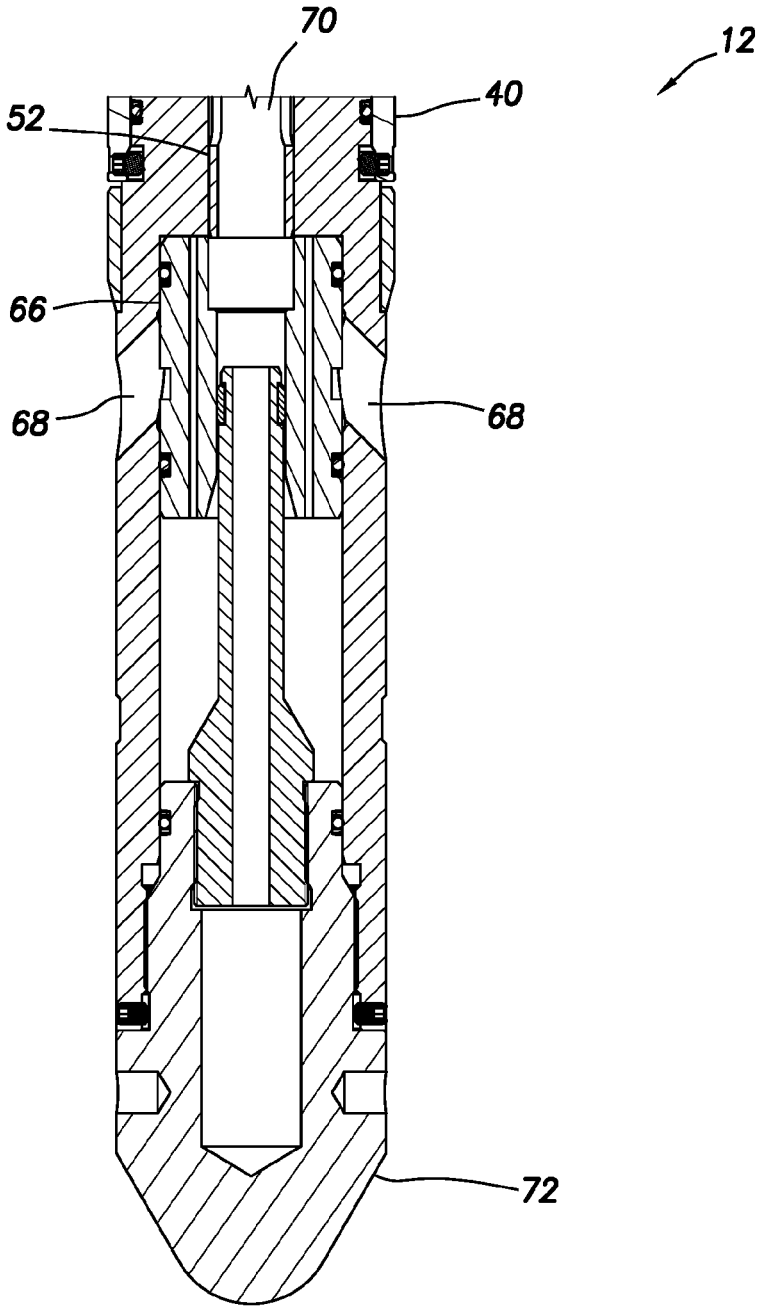
Figure 3A:
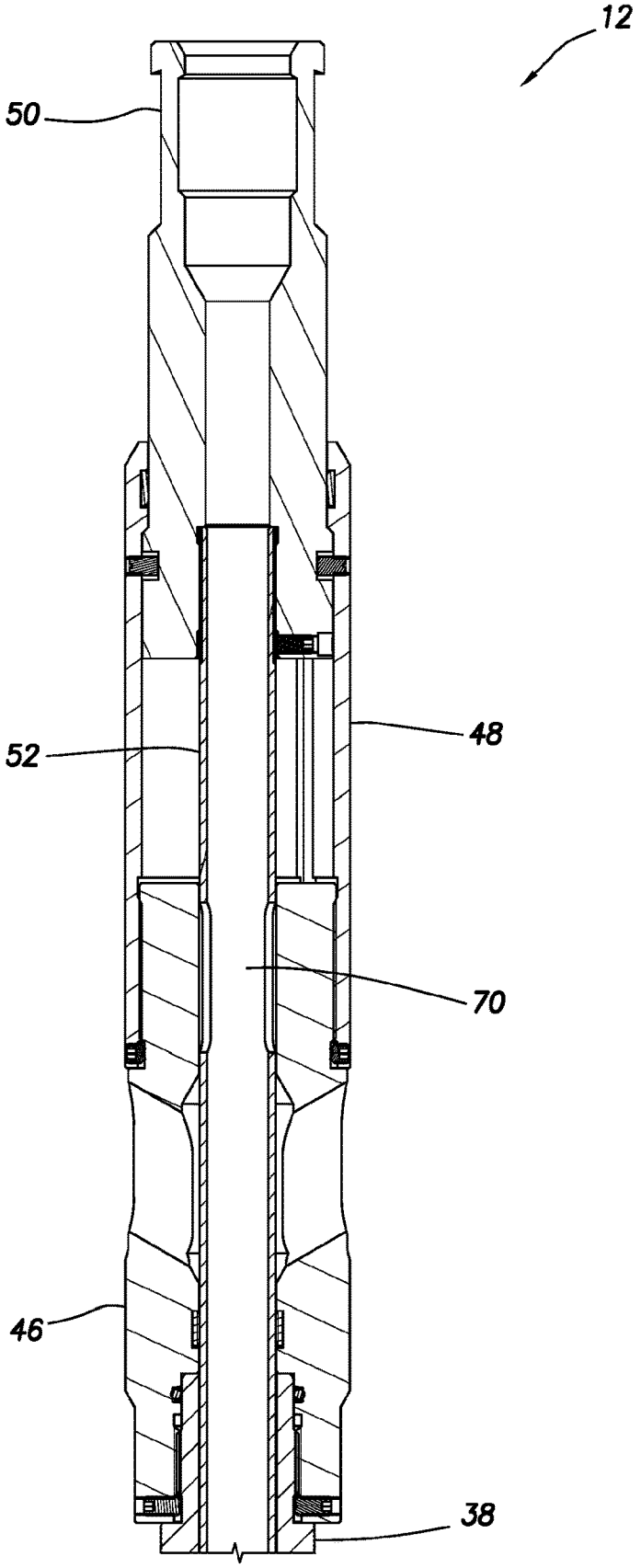
FIGS. 3A-G are representative cross-sectional views of successive axial sections of the downhole barrier in a set configuration.
Figure 3B:
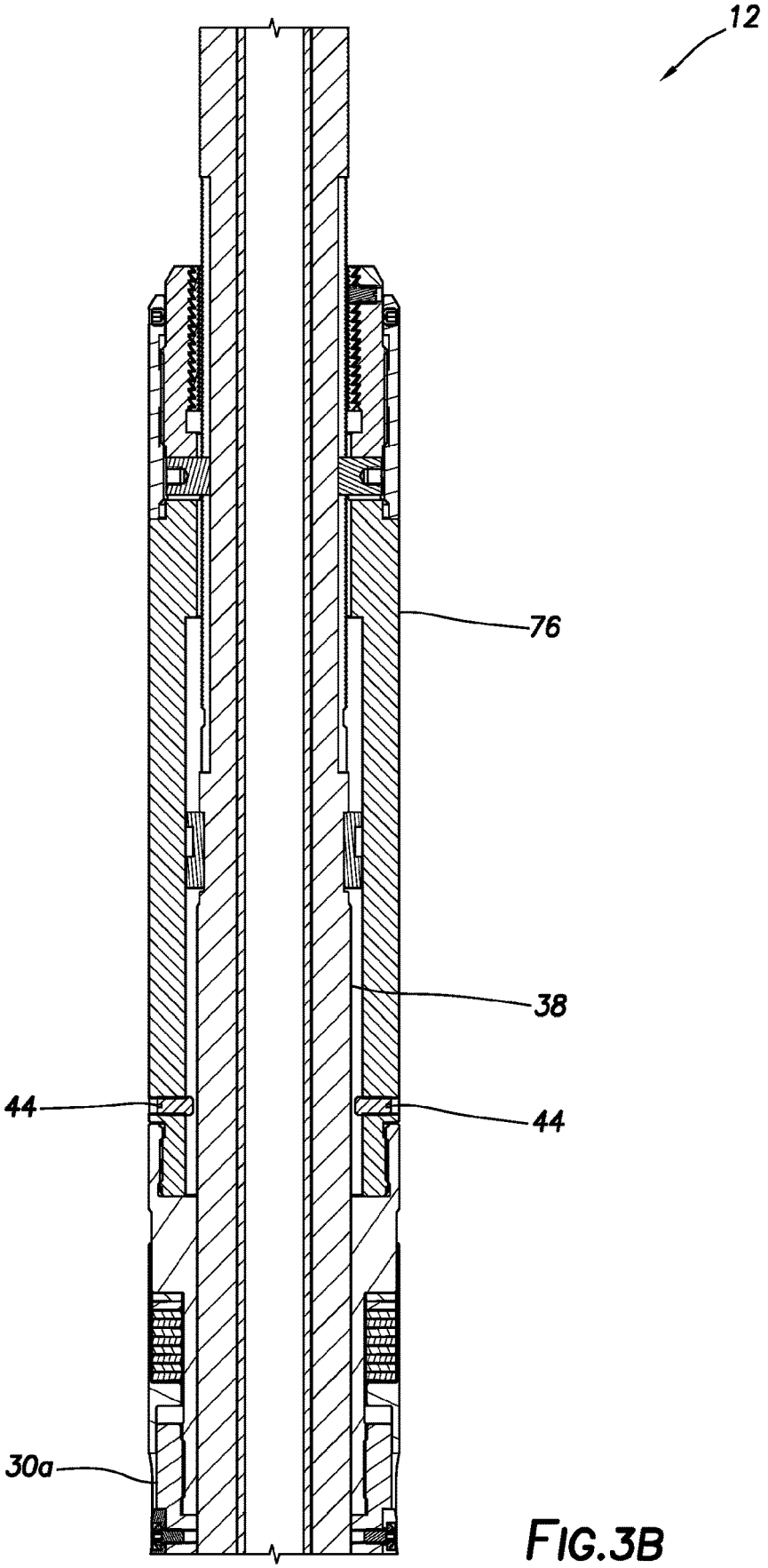
Figure 3C:
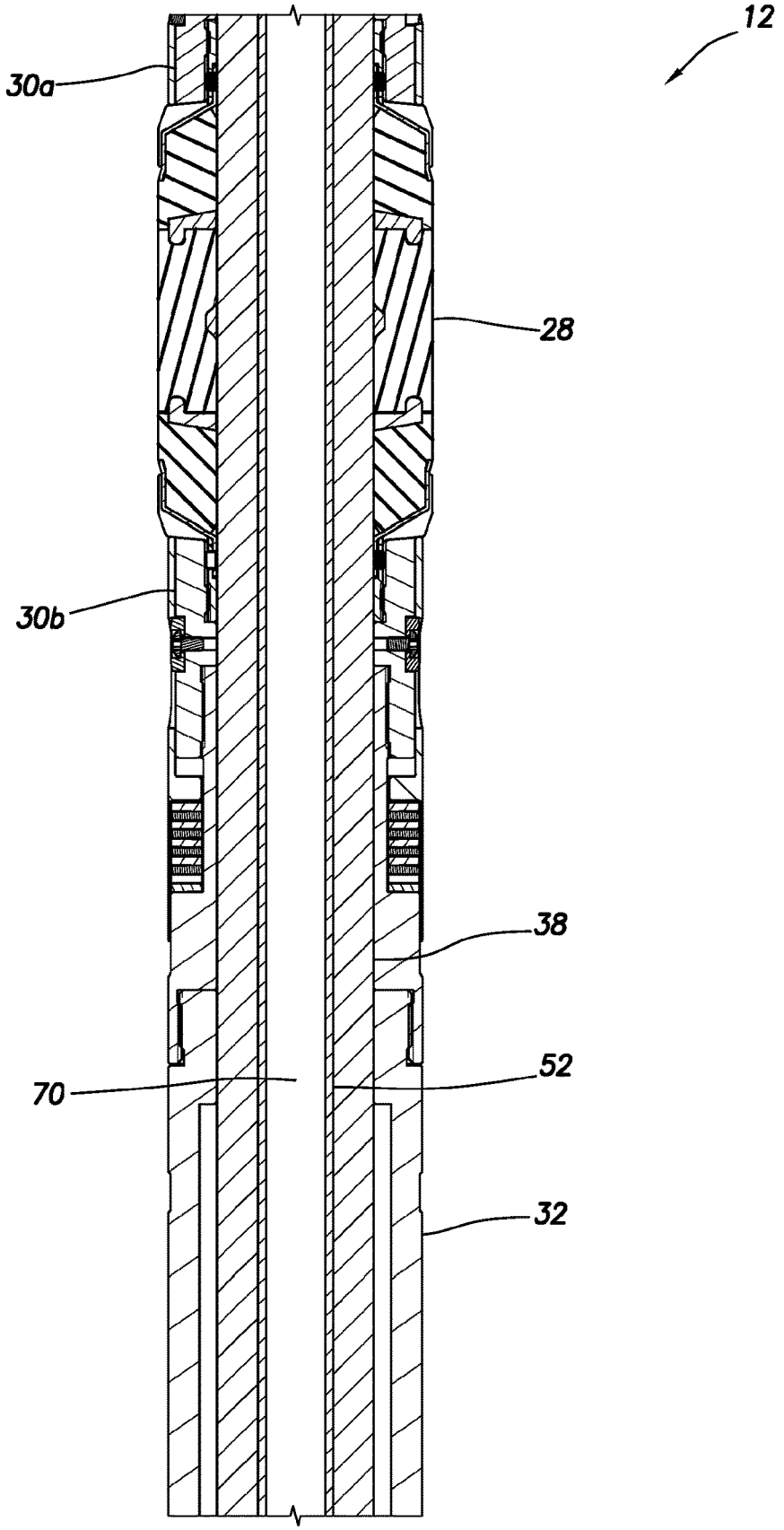
Figure 3D:
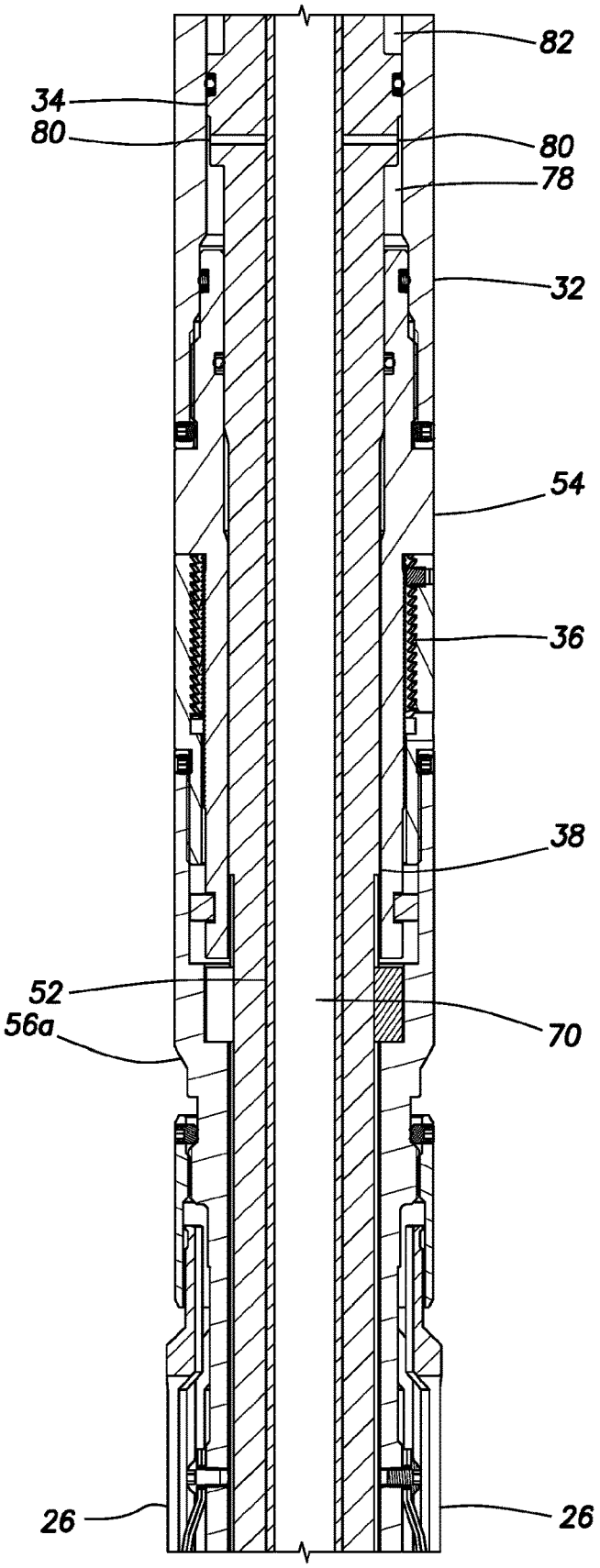
Figure 3E:
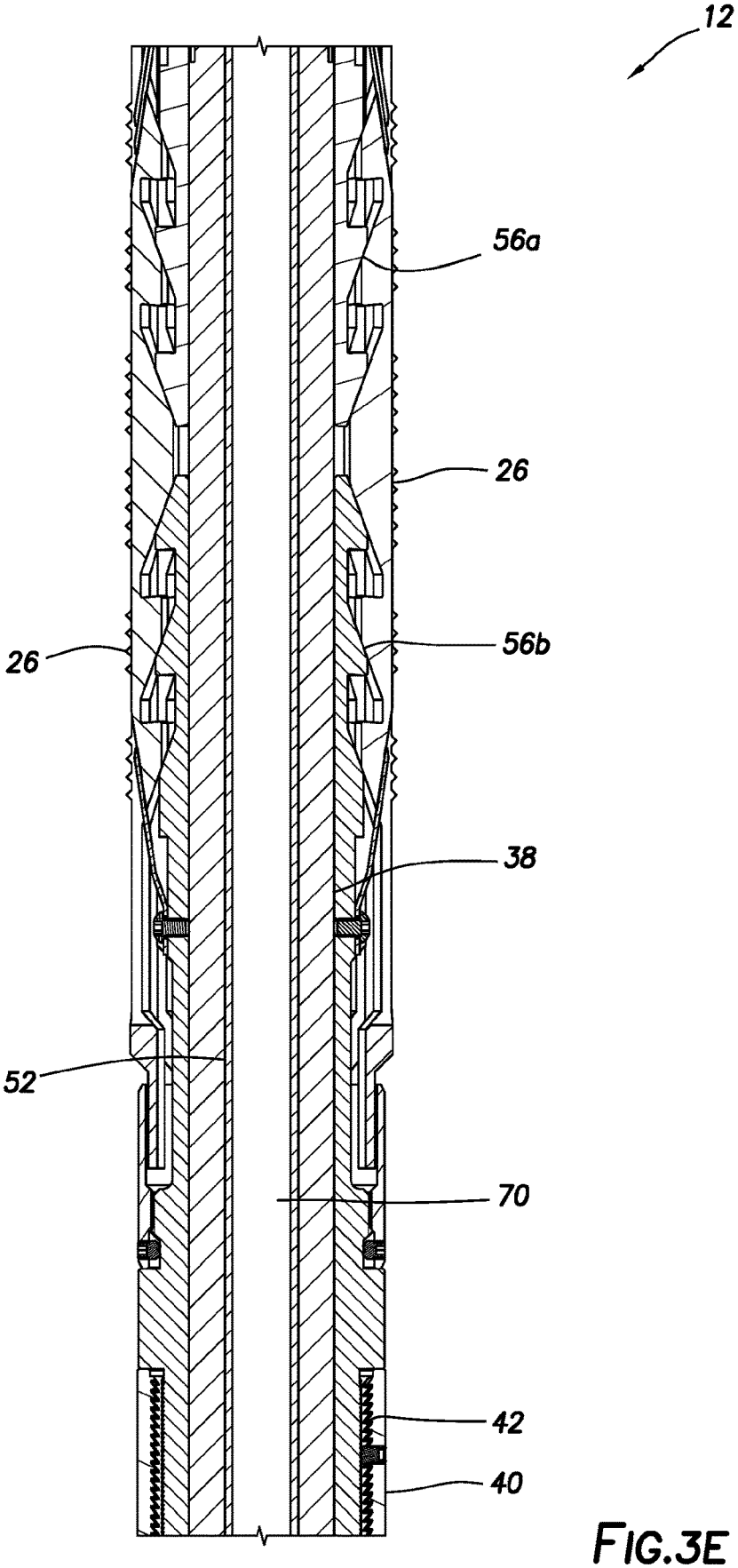
Figure 3F:
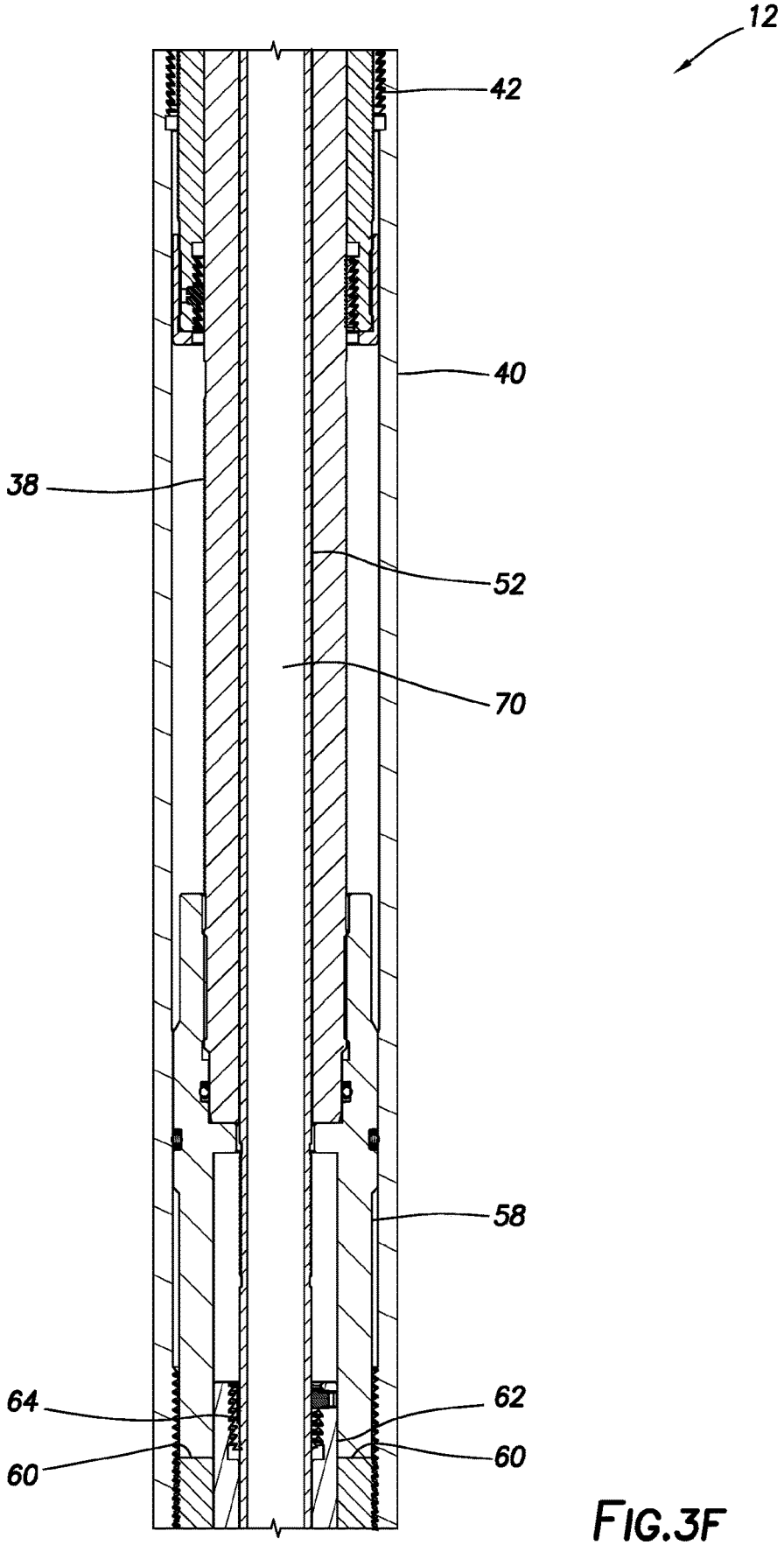
Figure 3G:
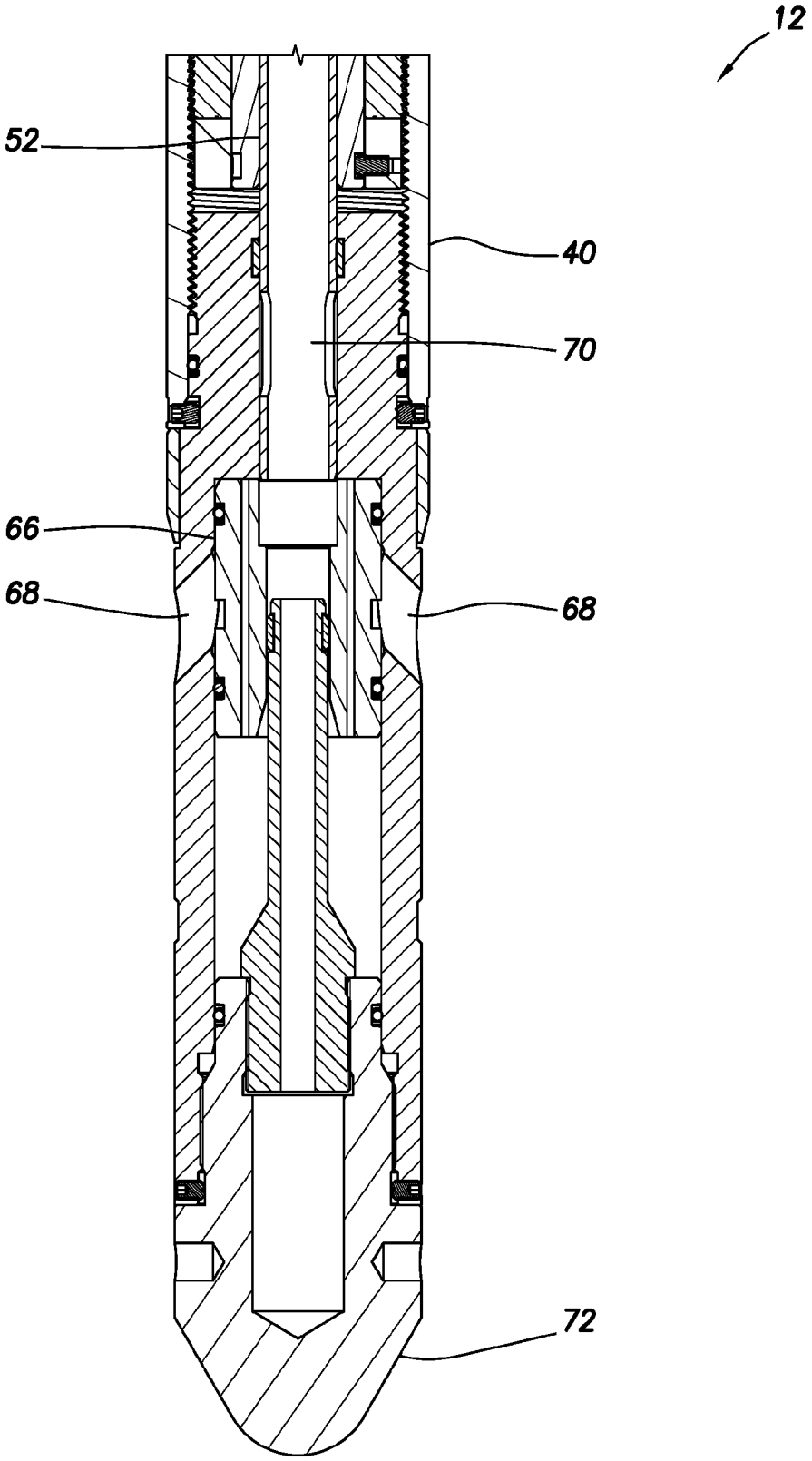

When the downhole barrier 12 is unset, all the compressive forces are removed from the seal element 28 and it is allowed to relax for retrieval. Using the principles described herein, the seal element 28 can seal against relatively large pressure differentials and, when unset, a maximum outer diameter OD (see FIG. 2E) of the downhole barrier 12 can be at its original run-in maximum outer diameter.

Referring to FIGS. 2A-G, cross-sectional views of successive axial sections of a more detailed example of the downhole barrier 12 are representatively illustrated. In FIGS. 2A-G, the downhole barrier 12 is of the type known to those skilled in the art as a bridge plug. When used in the FIG. 1 system 10, the downhole barrier 12 would be used to completely isolate the wellbore sections 16, 18 from each other. The downhole barrier 12 may be used in other systems and methods in keeping with the principles of this disclosure.

In the run-in configuration of FIGS. 2A-G, the downhole barrier 12 is not set. Slips 26 and the seal element 28 are inwardly retracted, so that the downhole barrier 12 can be conveyed through the wellbore 14 to a desired location for setting the barrier.

In this example, the seal element 28 comprises several components 28*a-c*, along with support and backup devices 28*d-g*. Gage rings 30*a,b* straddle the seal element 28 and are displaceable axially relative to the mandrel 38.

When an axial distance between the gage rings 30*a,b* decreases, compressive force in the seal element 28 increases and the seal element extends radially outward. Conversely, when the axial distance between the gage rings 30*a,b* increases, the compressive force in the seal element decreases and the seal element retracts radially inward.

The upper gage ring 30*a* is initially releasably secured via shear screws 44 against axial displacement relative to the mandrel 38. Thus, when the mandrel 38 is biased upward or downward, the upper gage ring 30*a* is similarly biased, and the upper gage ring displaces axially with the mandrel 38.

At its upper end, the mandrel 38 is connected to a ported housing 46 and an upper sleeve 48. Reciprocably received in the upper sleeve 48 is a connector 50 of the type known to those skilled in the art as a "fishing" neck. The connector 50 may be used to connect the downhole barrier 12 to a setting tool.

The connector 50 is also connected to an inner sleeve 52 that extends axially through most of the downhole barrier 12 within the mandrel 38. The connector 50 may be used to displace the inner sleeve 52 axially relative to the mandrel 38.

The lower gage ring 30*b* is connected to the boost housing 32. Thus, when the housing 32 is biased upward or downward, the lower gage ring 30*b* is similarly biased, and the lower gage ring displaces axially with the housing 32.

The boost housing 32 is connected to another housing 54 having a surface 54*a* grippingly engaged by the lock ring 36. The lock ring 36 permits downward displacement of an upper wedge 56*a* relative to the housings 32, 54 but prevents upward displacement of the upper wedge 56*a* relative to the housings 32, 54.

The upper wedge 56*a* underlies an upper section of the slips 26. A similar lower wedge 56*b* underlies a lower section of the slips 26. The upper and lower wedges 56*a,b* have a series of frusto-conical ramps, inclines or wedges formed thereon. When an axial distance between the wedges 56*a,b* is decreased, the slips 26 are thereby displaced radially outward. When the axial distance between the wedges 56*a,b* is increased, the slips 26 are thereby displaced radially inward.

The lower wedge 56*b* is connected to the housing 40 via the lock ring 42. The lower wedge 56*b* also axially abuts the housing 40, and so compressive force can be transmitted between the lower wedge 56*b* and the housing 40. The lock ring 42 permits upward displacement of the lower wedge 56*b* relative to the housing 40, but prevents downward displacement of the lower wedge relative to the housing 40.

The housing 40 is connected to the mandrel 38 via a releasable connector 58. The releasable connector 58 has threaded lugs 60 that are propped radially outward by a sleeve 62 into engagement with internal threads in the housing 40.

The sleeve 62 is connected to the inner sleeve 52 via a lock ring 64. The lock ring 64 permits downward displacement of the inner sleeve 52 relative to the sleeve 62, but prevents upward displacement of the inner sleeve 52 relative to the sleeve 62.

Near a lower end of the downhole barrier 12, a valve sleeve 66 blocks flow through ports 68. The valve sleeve 66 prevents fluid communication between an exterior of the downhole barrier 12 (e.g., corresponding to the lower wellbore section 18 in the FIG. 1 system 10) and an internal flow passage 70 extending axially through most of the downhole barrier 12. A bull plug 72 closes off a lower end of the flow passage 70 and the downhole barrier 12.

Referring now to FIGS. 3A-G, the downhole barrier 12 is representatively illustrated in a set configuration. Note that the seal element 28 is axially compressed and radially extended outward, so that it can sealingly engage an interior surface of a wellbore, a casing or another tubular. The slips 26 are outwardly extended, so that they can grippingly engage the interior surface of the wellbore, casing or other tubular and thereby prevent displacement of the downhole barrier 12 in the wellbore 14.

To set the downhole barrier 12, a setting tool 74 (see FIG. 1) can be used to apply a downward force to an outer setting sleeve 76, thereby shearing the shear screws 44 and displacing the outer setting sleeve downward relative to the mandrel 38. The setting sleeve 76 is connected to the upper gage ring 30*a*. Thus, downward displacement of the setting sleeve 76 relative to the mandrel 38 results in downward displacement of the upper gage ring 30*a*, the seal element 28, the lower gage ring 30*b*, the housings 32, 54, the upper wedge 56*a* and the slips 26 relative to the mandrel 38.

The lower wedge 56*b* remains fixed relative to the mandrel 38 via the releasable connector 58 and the housing 40. Thus, the axial distance between the upper and lower wedges 56*a,b* is reduced and the slips 26 are displaced outward to their set configuration.

The axial distance between the gage rings 30*a,b* is also reduced. The seal element 28 is axially compressed between the gage rings 30*a,b* and is deformed radially outward to its set configuration.

Referring additionally now to FIG. 4, the boost system of the downhole barrier 12 is representatively illustrated with the barrier in the set configuration. In this view it may be seen that fluid pressure in the flow passage 70 (and in the upper wellbore section 16 in the FIG. 1 system 10) is communicated to a chamber 78 below the piston 34 via ports 80 formed radially through the piston. Another chamber 82 is above the piston 34 and is in communication with pressure external to the downhole barrier 12 below the seal element 28 (e.g., the lower wellbore section 18 in the FIG. 1 system 10).

By carefully selecting the areas corresponding to the diameters A, B & C, the additional pack-off force or compressive boost force applied to the seal element 28 due to a pressure differential from above to below or from below to above the downhole barrier 12 can be made equal if desired. In addition, excessive boost force due to a pressure differential from above to below applied to the mandrel 38 can be avoided.

Figure 5:
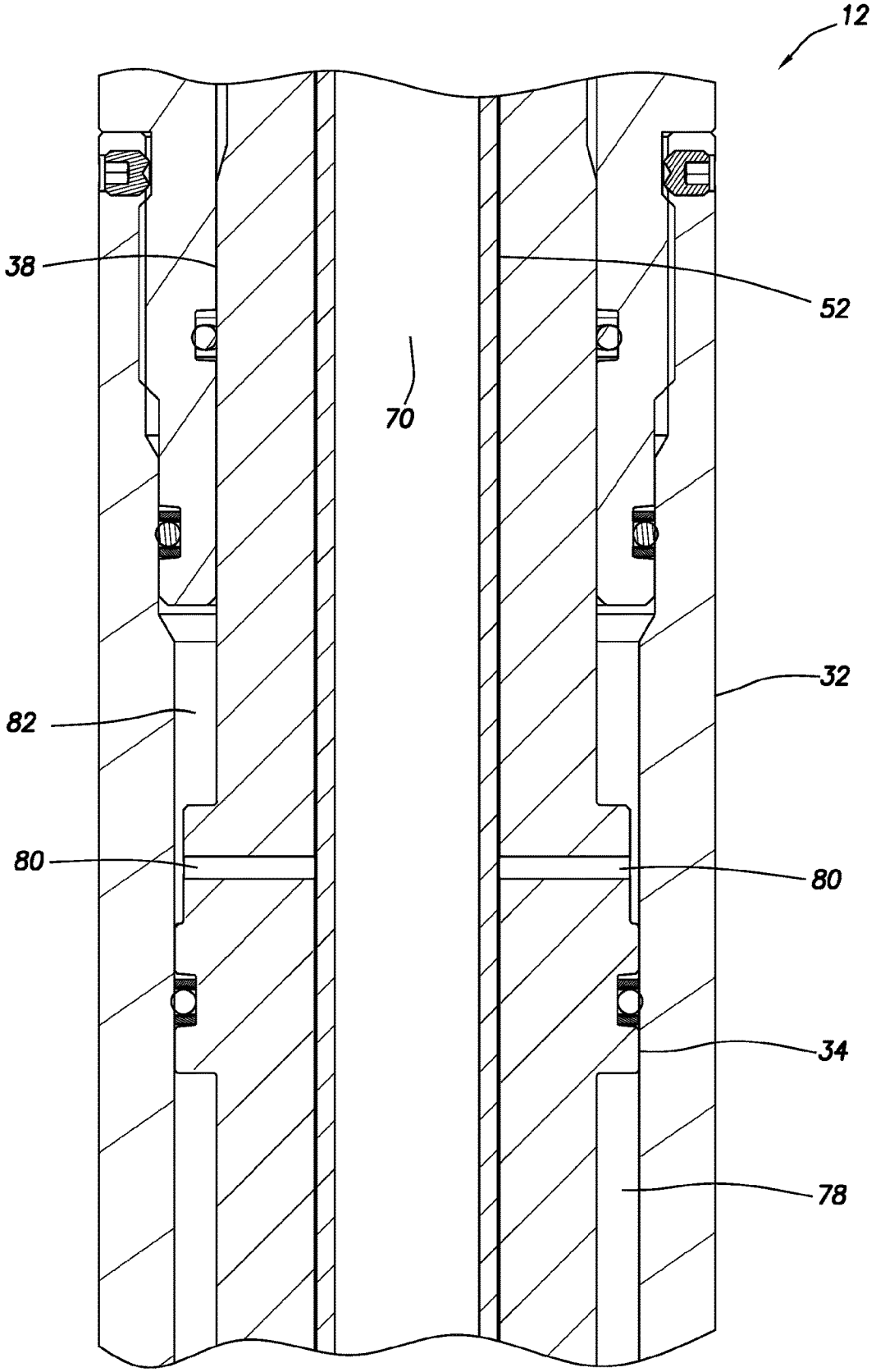
FIG. 5 is a representative cross-sectional view of the boost system, in which pressures applied to chambers in a boost housing of the boost system counteract each other.

Referring to FIG. 5, the manner in which the pressures applied to the chambers 78, 82 in the boost housing 32 counteract each other can be more clearly seen. Pressure applied to the lower chamber 78 and acting on a lower piston area of the piston 34 biases the mandrel 34 upward and the boost housing 32 downward. Pressure applied to the upper chamber 82 and acting on an upper piston area of the piston 34 biases the mandrel 34 downward and the boost housing 32 upward.

Figure 6:
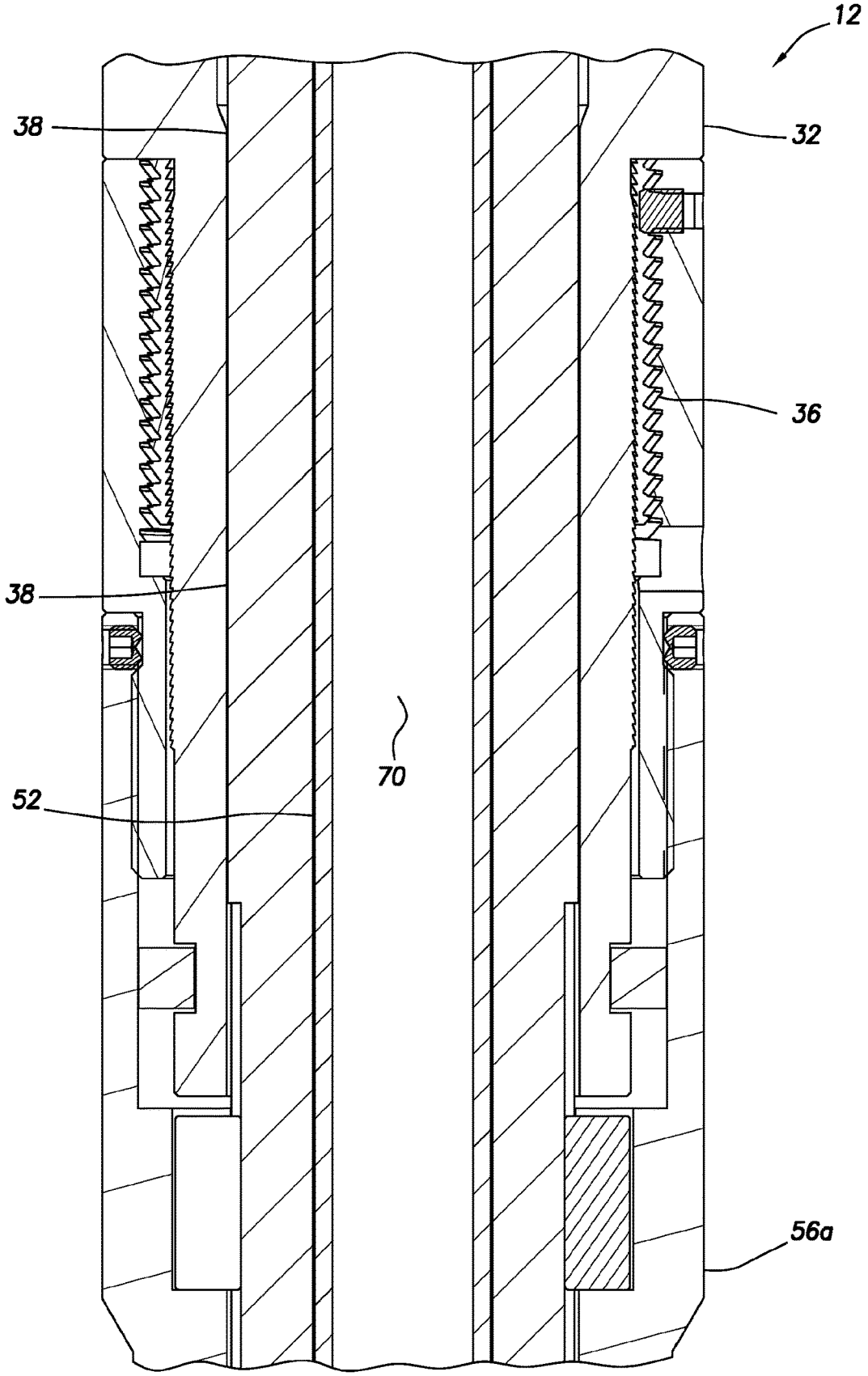
FIG. 6 is a representative cross-sectional view of the boost system, in which a lock ring permits the boost housing to displace upward relative to an upper wedge of the downhole barrier.

Referring to FIG. 6, the lock ring 36 permits the boost housing 32 to displace upward relative to the upper wedge 56*a*. Thus, increased pressure differential from below applied to the upper chamber 82 will bias the boost housing 32 and lower gage ring 30*b* to displace upward to thereby increase the compressive force in the seal element 28. The lock ring 36 will prevent any subsequent downward displacement of the boost housing 32 relative to the upper wedge 56*a*.

Figure 7:
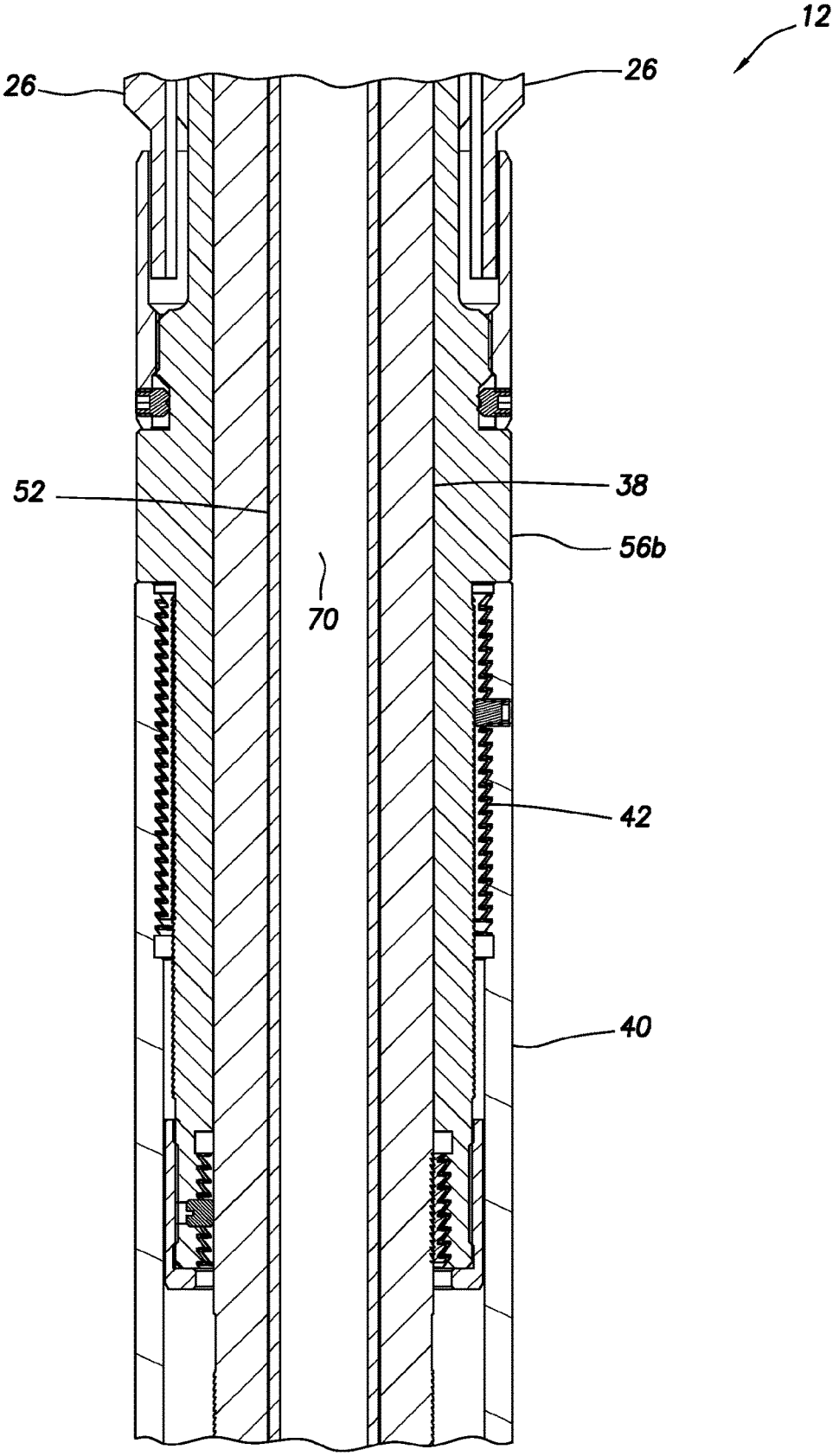
FIG. 7 is a representative cross-sectional view of the boost system, in which a lock ring permits a housing to displace downward relative to a lower wedge of the downhole barrier.

Referring to FIG. 7, the lock ring 42 permits the housing 40 to displace downward relative to the lower wedge 56*b*. Thus, increased pressure differential from above applied to the lower chamber 78 will bias the mandrel 38 and upper gage ring 30*a* to displace downward to thereby increase the compressive force in the seal element 28. The lock ring 42 will prevent any subsequent upward displacement of the mandrel 38 and housing 40 relative to the lower wedge 56*b*.

Figure 8A:
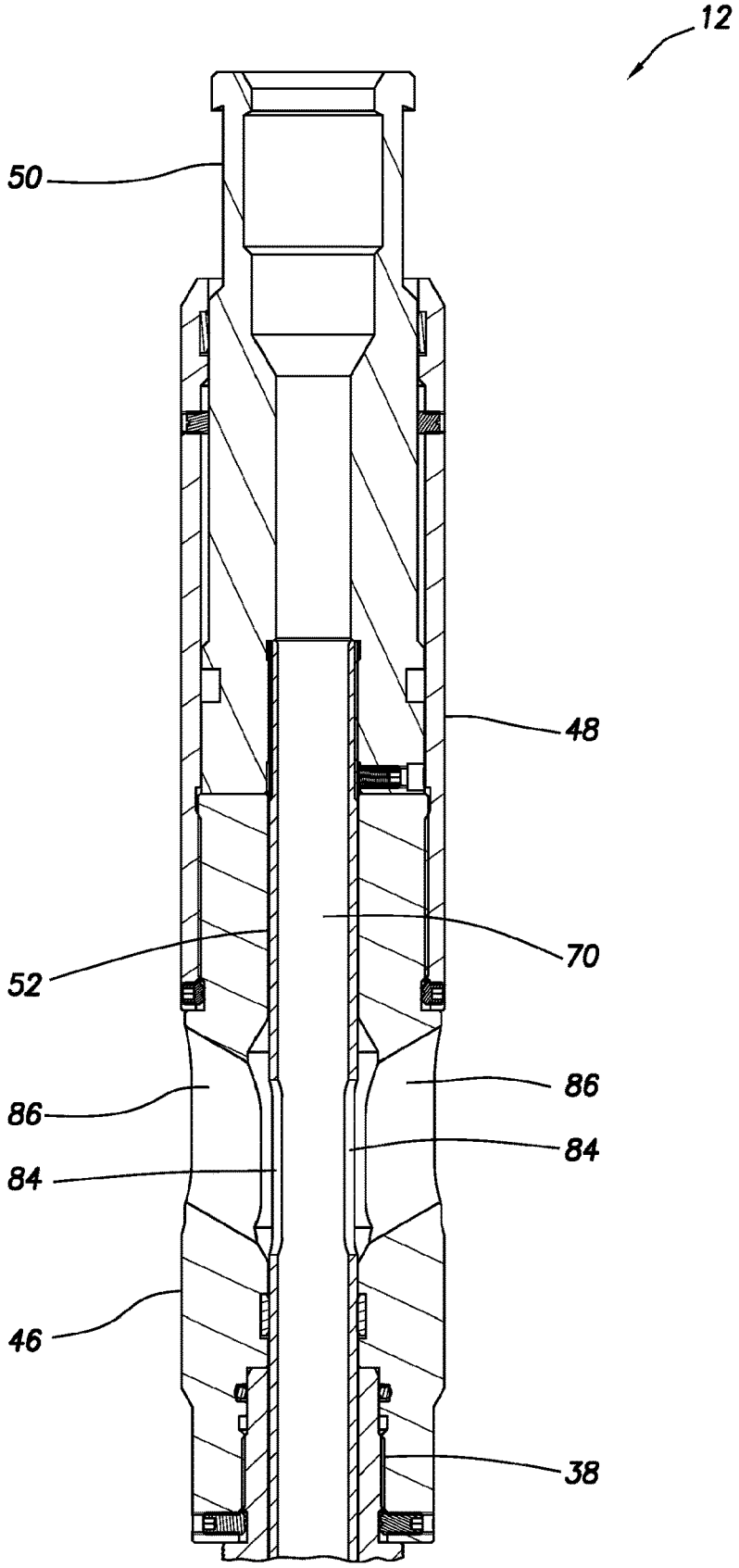
FIGS. 8A & B are representative cross-sectional views of upper and lower sections of the downhole barrier in an equalized configuration.

Referring to FIGS. 8A & B, upper and lower ends of the downhole barrier 12 are representatively illustrated in an equalized configuration in preparation for unsetting the barrier. In this configuration, pressures above and below the downhole barrier 12 (e.g., in the upper and lower wellbore sections 16, 18) are equalized by placing them in fluid communication with each other, prior to unsetting the barrier.

As depicted in FIG. 8A, the connector 50 and inner sleeve 52 are displaced downward relative to the upper sleeve 48 and ported housing 46. The flow passage 70 is thereby placed in fluid communication with the exterior of the barrier 12 above the seal element 28 via ports 84 in the inner sleeve 52 and ports 86 in the ported housing 46.

Figure 8B:
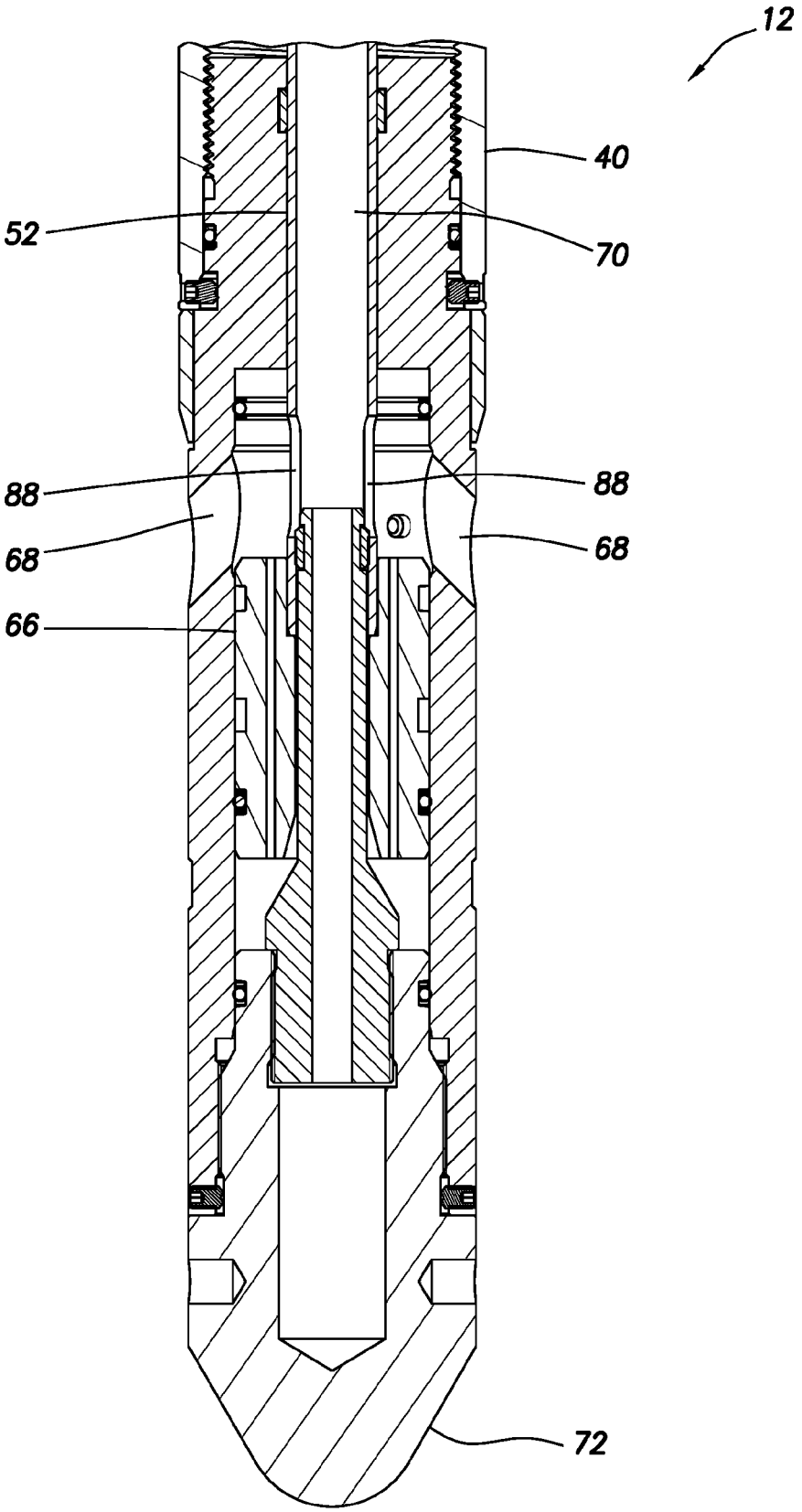
Figure 9A:
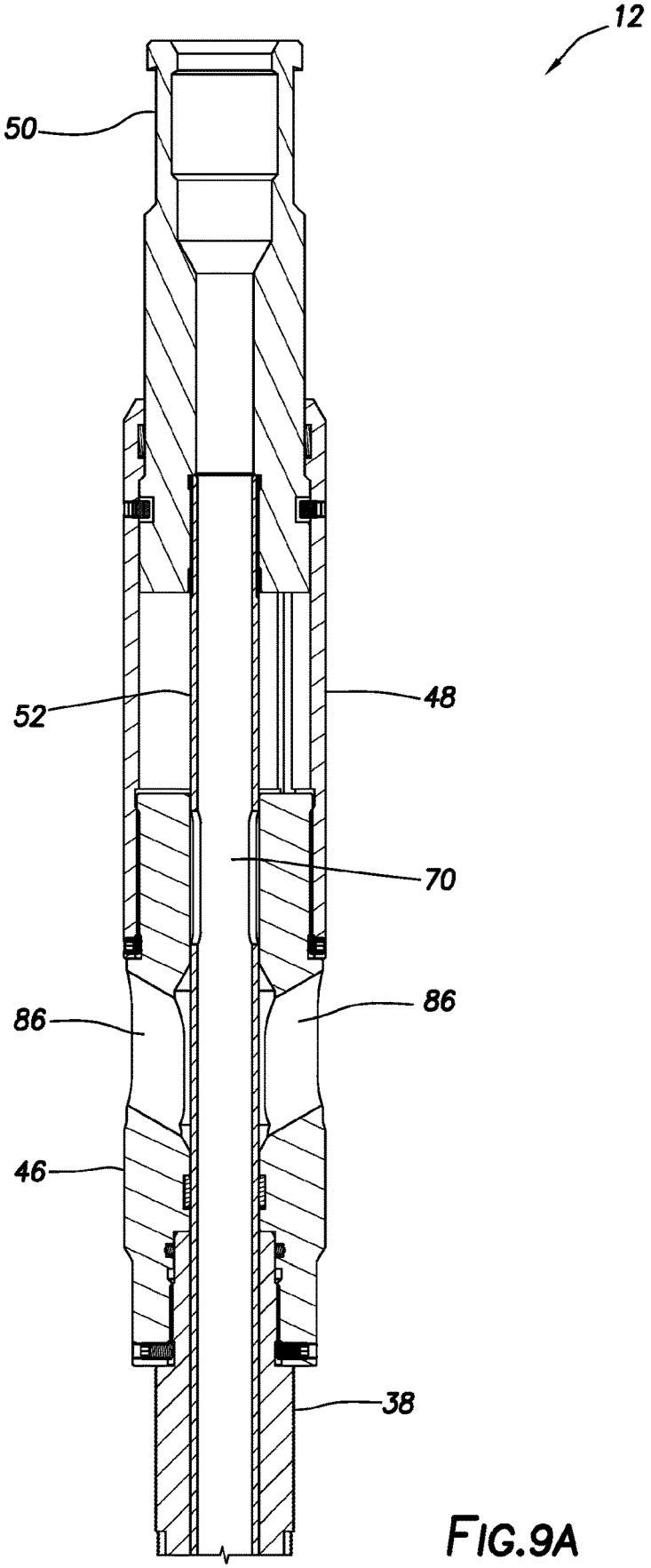
FIGS. 9A-G are representative cross-sectional views of successive axial sections of the downhole barrier in an unset configuration.
Figure 9B:
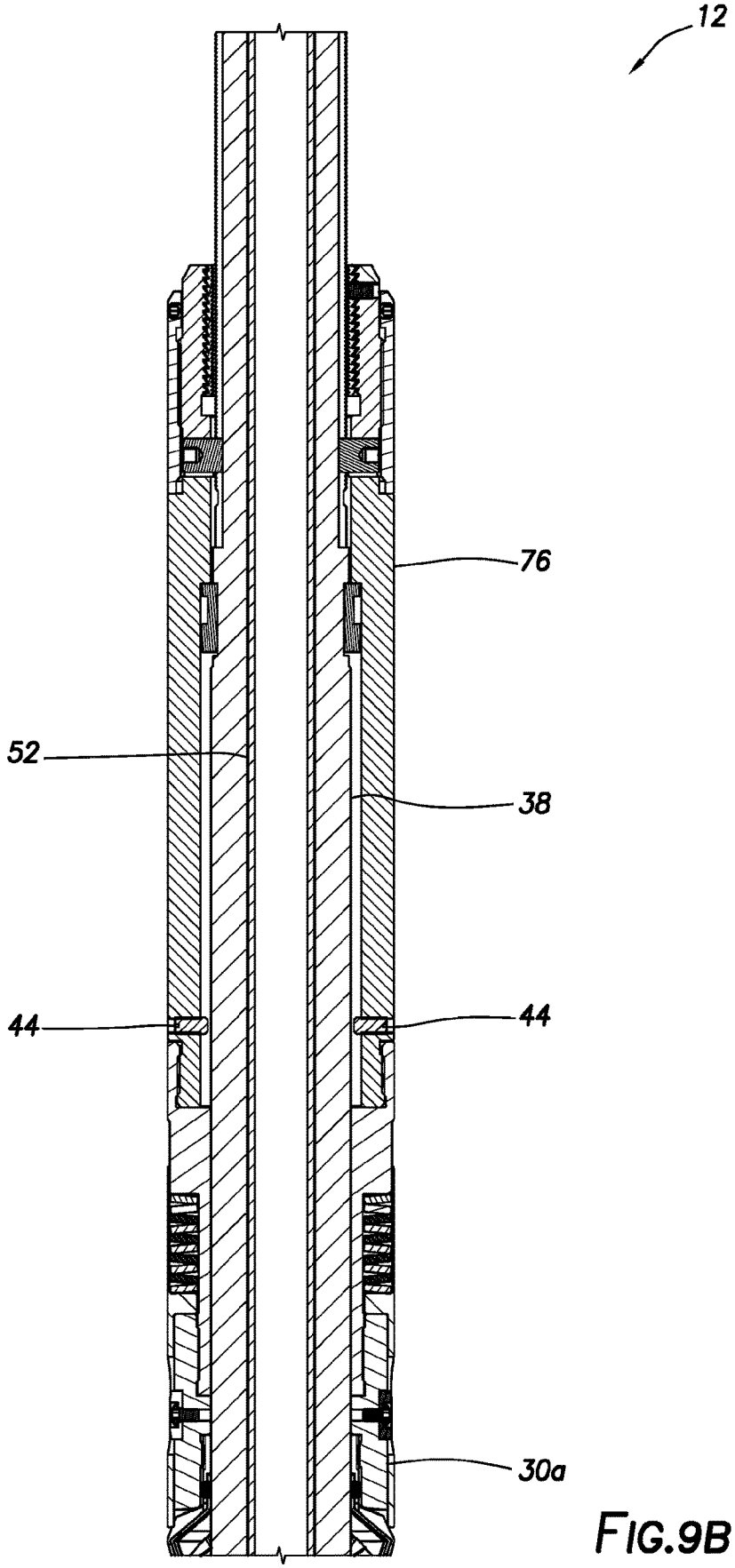
Figure 9C:
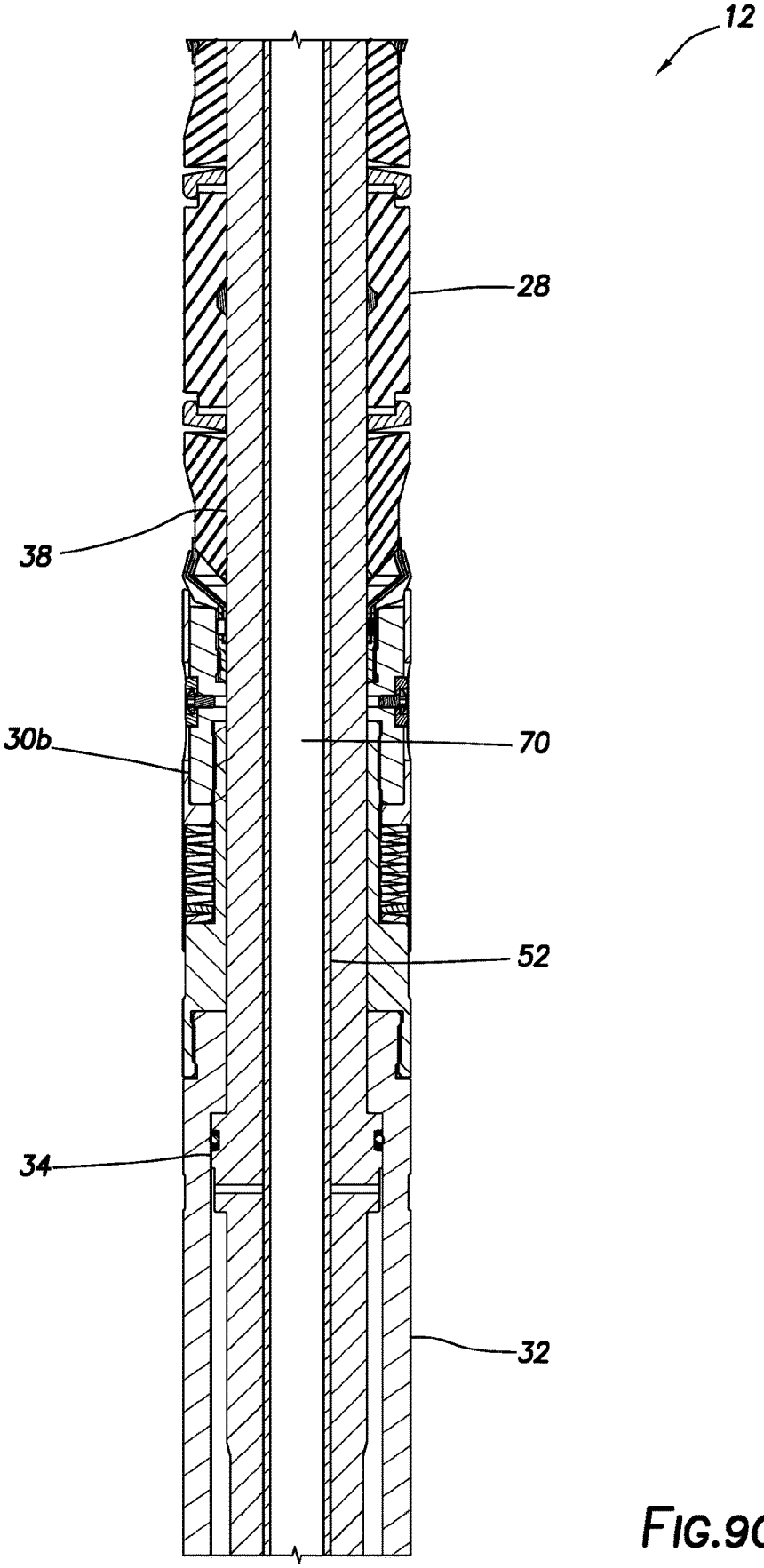
Figure 9D:
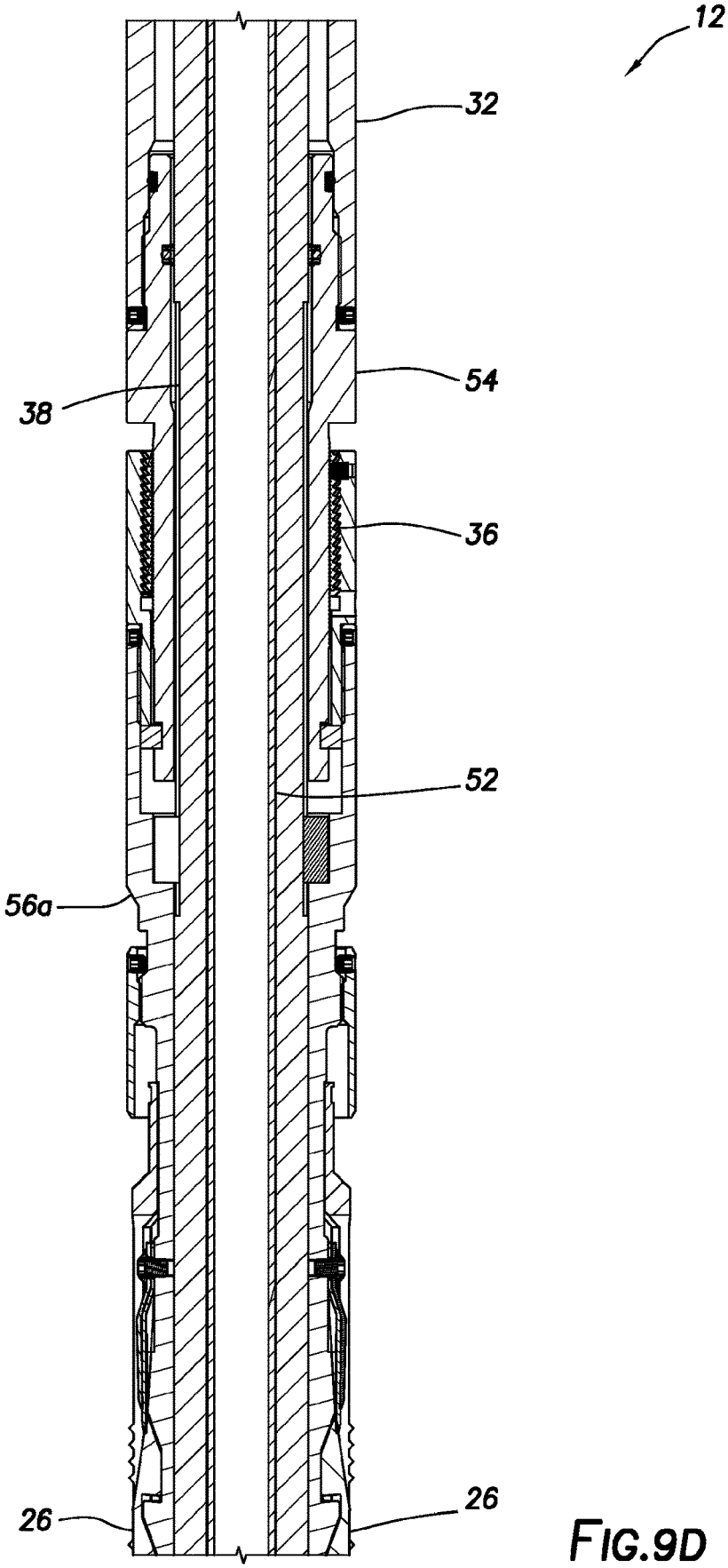
Figure 9E:
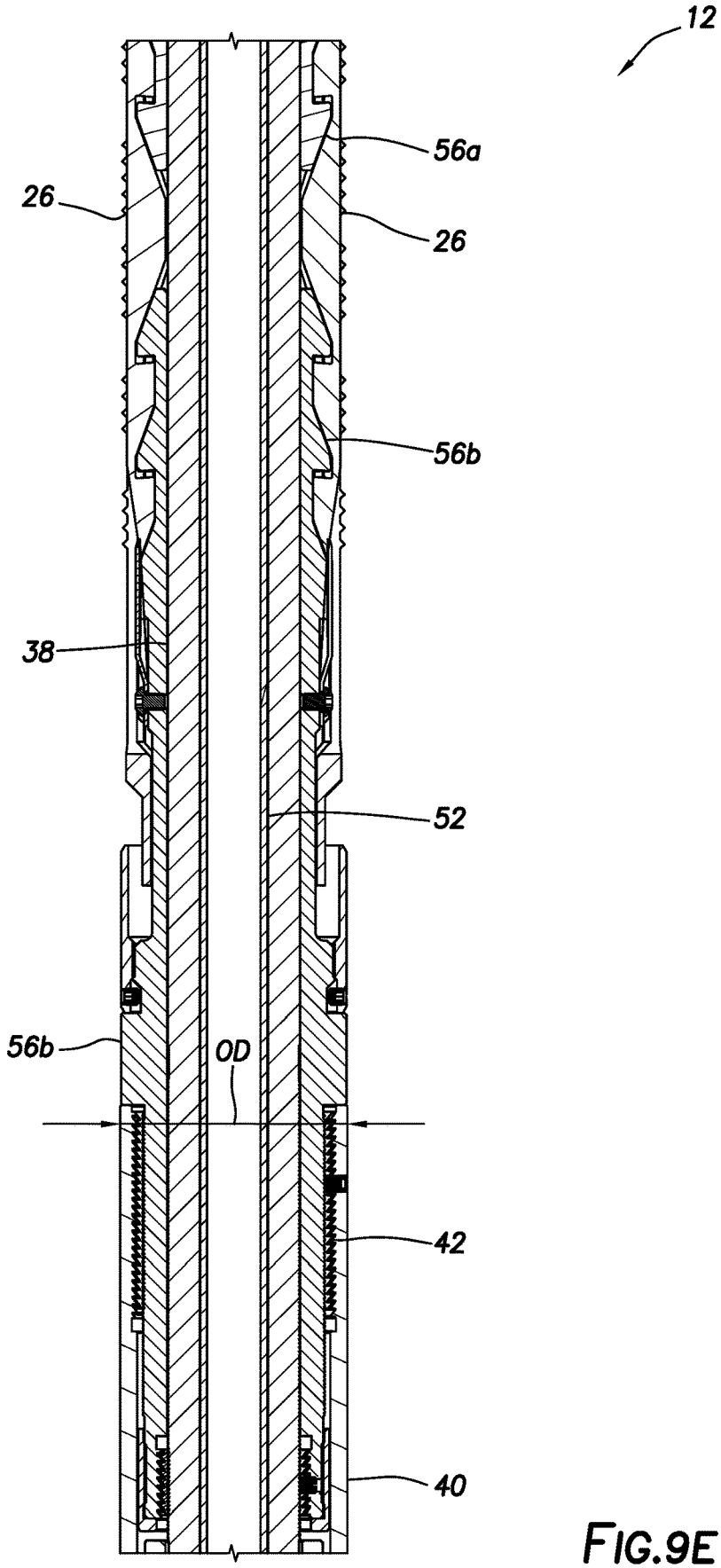
Figure 9F:
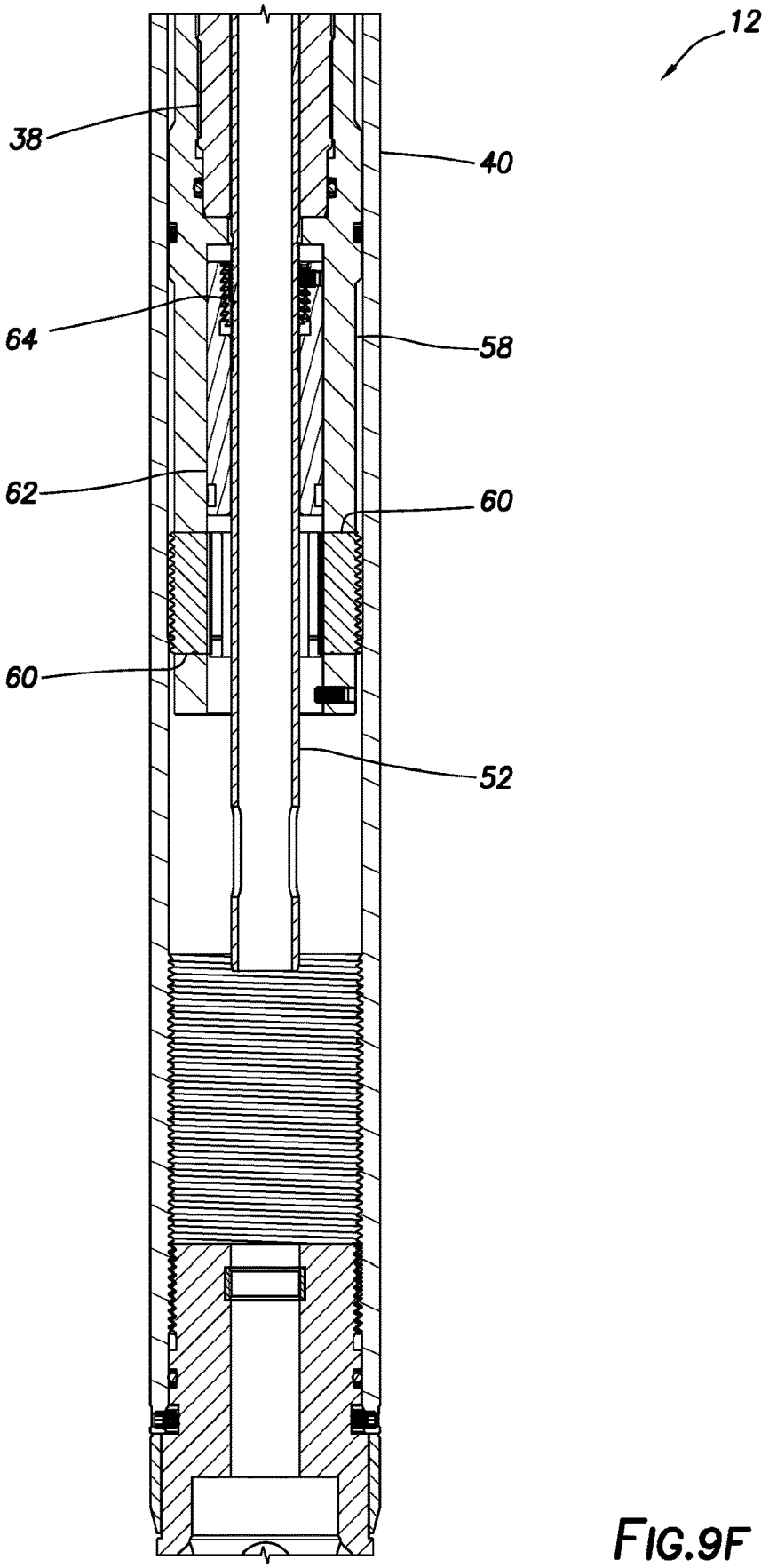
Figure 9G:
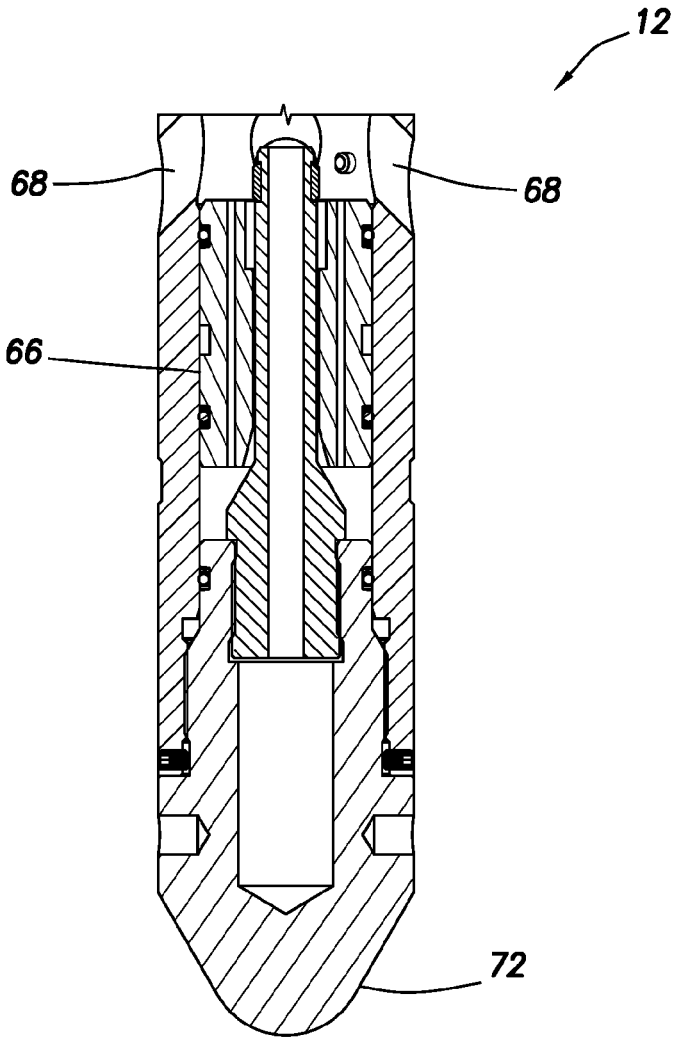

As depicted in FIG. 8B, when the inner sleeve 52 is displaced downward, it engages and downwardly displaces the valve sleeve 66. In this manner, the flow passage 70 is placed in fluid communication with the exterior of the barrier 12 below the seal element 28 via ports 88 in the inner sleeve 52 and the ports 68. Thus, pressures above and below the barrier 12 are equalized in preparation for unsetting the barrier.

Referring to FIGS. 9A-G, the downhole barrier 12 is representatively illustrated in an unset configuration. Note that the maximum OD of the barrier 12 is no greater in the unset configuration than it was in the original, run-in configuration of the barrier depicted in FIGS. 2A-G.

The connector 50 is displaced upward, so that the mandrel 38 is no longer connected to the housing 40 via the releasable connector 58. The sleeve 62 is displaced upward with the inner sleeve 52, and the lugs 60 are no longer supported in engagement with the housing 40.

The housing 40 and the lower wedge 56*b* are displaced downward, thereby increasing the axial distance between the upper and lower wedges 56*a,b* and allowing the slips 26 to inwardly retract. The axial distance between the upper and lower gage rings 30*a,b* is also increased, thereby relieving the compressive force in the seal element 28 and allowing it to retract radially inward. The barrier 12 can now be conveniently retrieved from the well.

It may now be fully appreciated that the above disclosure provides significant advancements to the art of constructing and utilizing downhole barriers for use in subterranean wells. In examples described above, the downhole barrier 12 includes boost areas for applying compressive boost forces to the seal element 28 in response to pressure differentials applied in uphole and downhole directions.

The above disclosure provides to the art a downhole barrier 12 for use in a subterranean well. In one example, the downhole barrier 12 can include a boost housing 32 disposed axially between a slip 26 and a seal element 28, a mandrel 38 extending axially through the boost housing 32 and the seal element 28, and a piston 34 fixed to the mandrel 38, the piston 34 separating first and second fluid chambers 78, 82 in the boost housing 32. The first fluid chamber 78 is positioned axially between the slip 26 and the second fluid chamber 82. The first fluid chamber 78 is in fluid communication with an interior flow passage 70 of the mandrel 38, and the second fluid chamber 82 is in fluid communication with an exterior of the downhole barrier 12.

An outer area A of the mandrel 38 in the second fluid chamber 82 may be equal to twice a difference between an inner area B of the boost housing 32 and an outer area C of the mandrel 38 in the first fluid chamber 78.

The downhole barrier 12 may include a wedge 56*a* configured to outwardly extend the slip 26. A lock ring 36 may permit axial displacement of the boost housing 32 away from the wedge 56*a* and prevent axial displacement of the boost housing 32 toward the wedge 56*a*.

The downhole barrier 12 may include a wedge 56*b* configured to outwardly extend the slip 26. A lock ring 42 may permit displacement of the mandrel 38 in a first axial direction relative to the wedge 56*b* and prevent displacement of the mandrel 38 in a second axial direction relative to the wedge 56*b*, the second axial direction being opposite to the first axial direction.

In a set configuration of the downhole barrier 12, a first pressure differential applied in a first axial direction (e.g., from uphole to downhole) across the seal element 28 may cause a first compressive force to be applied to the seal element 28, and a second pressure differential applied in a second axial direction (e.g., from downhole to uphole) across the seal element 28 may cause a second compressive force to be applied to the seal element 28. The first and second pressure differentials may be equal, the first and second compressive forces may be equal, and the second axial direction may be opposite to the first axial direction.

The boost housing 32 may be rigidly connected to a gage ring 30*b*. The gage ring 30*b* may be configured to transmit a compressive force from the boost housing 32 to the seal element 28.

The first and second fluid chambers 78, 82 may have a same outer diameter (e.g., corresponding to area B). The first and second fluid chambers 78, 82 may have different inner diameters (e.g., corresponding to areas C & A).

The interior flow passage 70 may extend axially through the mandrel 38.

The seal element 28 may be configured to extend radially outward in response to a compressive force applied to the seal element 28.

Also provided to the art by the above disclosure is a system 10 for use with a subterranean well. In one example, the system 10 can include a downhole barrier 12 set in a wellbore 14 of the well. In this example, the downhole barrier 12 includes a boost housing 32 disposed axially between a slip 26 and a seal element 28, a mandrel 38 extending axially through the boost housing 32 and the seal element 28, and a piston 34 fixed to the mandrel 38. The piston 34 separates first and second fluid chambers 78, 82 in the boost housing 32. An outer area A of the mandrel 38 in the second fluid chamber 82 is equal to twice a difference between an inner area B of the boost housing 32 and an outer area C of the mandrel 38 in the first fluid chamber 78.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A downhole barrier for use in a subterranean well, the downhole barrier comprising:

a boost housing disposed axially between a slip and a seal element;

a mandrel extending axially through the boost housing and the seal element; and a piston fixed to the mandrel, the piston separating first and second fluid chambers in the boost housing, in which the first fluid chamber is positioned axially between the slip and the second fluid chamber, and in which the first fluid chamber is in fluid communication with an interior flow passage of the mandrel, and the second fluid chamber is in fluid communication with an exterior of the downhole barrier.

2. The downhole barrier of claim 1, in which an outer area of the mandrel in the second fluid chamber is equal to twice a difference between an inner area of the boost housing and an outer area of the mandrel in the first fluid chamber.

3. The downhole barrier of claim 1, further comprising a wedge configured to outwardly extend the slip, and in which a lock ring permits axial displacement of the boost housing away from the wedge and prevents axial displacement of the boost housing toward the wedge.

4. The downhole barrier of claim 1, further comprising a wedge configured to outwardly extend the slip, and in which a lock ring permits displacement of the mandrel in a first axial direction relative to the wedge and prevents displacement of the mandrel in a second axial direction relative to the wedge, the second axial direction being opposite to the first axial direction.

5. The downhole barrier of claim 1, in which, in a set configuration of the downhole barrier, a first pressure differential applied in a first axial direction across the seal element causes a first compressive force to be applied to the seal element, and a second pressure differential applied in a second axial direction across the seal element causes a second compressive force to be applied to the seal element, and in which the first and second pressure differentials are equal, the first and second compressive forces are equal, and the second axial direction is opposite to the first axial direction.

6. The downhole barrier of claim 1, in which the boost housing is rigidly connected to a gage ring, whereby the gage ring is configured to transmit a compressive force from the boost housing to the seal element.

7. The downhole barrier of claim 1, in which the first and second fluid chambers have a same outer diameter.

8. The downhole barrier of claim 7, in which the first and second fluid chambers have different inner diameters.

9. The downhole barrier of claim 1, in which the interior flow passage extends axially through the mandrel.

10. The downhole barrier of claim 1, in which the seal element is configured to extend radially outward in response to a compressive force applied to the seal element.

11. A system for use with a subterranean well, the system comprising:

a downhole barrier set in a wellbore of the well, the downhole barrier comprising:

a boost housing disposed axially between a slip and a seal element;

a mandrel extending axially through the boost housing and the seal element; and a piston fixed to the mandrel, the piston separating first and second fluid chambers in the boost housing, in which an outer area of the mandrel in the second fluid chamber is equal to twice a difference between an inner area of the boost housing and an outer area of the mandrel in the first fluid chamber.

12. The system of claim 11, further comprising a wedge configured to outwardly extend the slip, and in which a lock ring permits axial displacement of the boost housing away from the wedge and prevents axial displacement of the boost housing toward the wedge.

13. The system of claim 11, further comprising a wedge configured to outwardly extend the slip, and in which a lock ring permits displacement of the mandrel in a first axial direction relative to the wedge and prevents displacement of the mandrel in a second axial direction relative to the wedge, the second axial direction being opposite to the first axial direction.

14. The system of claim 11, in which a first pressure differential applied from uphole to downhole across the seal element causes a first compressive force to be applied to the seal element, and a second pressure differential applied from downhole to uphole across the seal element causes a second compressive force to be applied to the seal element, and in which the first and second pressure differentials are equal, and the first and second compressive forces are equal.

15. The system of claim 11, in which the boost housing is rigidly connected to a gage ring which transmits a compressive force from the boost housing to the seal element.

16. The system of claim 11, in which the first and second fluid chambers have a same outer diameter.

17. The system of claim 16, in which the first and second fluid chambers have different inner diameters.

18. The system of claim 11, in which the first fluid chamber is positioned axially between the slip and the second fluid chamber, and in which the first fluid chamber is in fluid communication with an interior flow passage of the mandrel, and the second fluid chamber is in fluid communication with an exterior of the downhole barrier.

19. The system of claim 18, in which the interior flow passage extends axially through the mandrel.

20. The system of claim 11, in which the seal element is extended radially outward in response to a compressive force applied to the seal element.

* * * * *